US011413670B2

(12) United States Patent
Serizawa et al.

(10) Patent No.: US 11,413,670 B2
(45) Date of Patent: Aug. 16, 2022

(54) COOLING DEVICE AND COOLING METHOD OF HOT-ROLLED STEEL SHEET

(71) Applicant: NIPPON STEEL CORPORATION, Tokyo (JP)

(72) Inventors: Yoshihiro Serizawa, Tokyo (JP); Takayuki Murai, Tokyo (JP); Yoshiaki Suematsu, Tokyo (JP); Satoru Hayashi, Tokyo (JP); Tomoya Nakao, Tokyo (JP); Hiroshi Niitani, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 363 days.

(21) Appl. No.: 16/330,671

(22) PCT Filed: Sep. 14, 2017

(86) PCT No.: PCT/JP2017/033248
§ 371 (c)(1),
(2) Date: Mar. 5, 2019

(87) PCT Pub. No.: WO2018/056164
PCT Pub. Date: Mar. 29, 2018

(65) Prior Publication Data

US 2019/0210080 A1 Jul. 11, 2019

(30) Foreign Application Priority Data

Sep. 23, 2016 (JP) ..... JP2016-185395
Jul. 31, 2017 (WO) ..... PCT/JP2017/027720

(51) Int. Cl.
*B21B 37/76* (2006.01)
*B21B 45/02* (2006.01)
(Continued)

(52) U.S. Cl.
CPC ..... *B21B 37/76* (2013.01); *B21B 38/006* (2013.01); *B21B 45/02* (2013.01);
(Continued)

(58) Field of Classification Search
CPC . B21B 45/0218; B21B 45/0233; B21B 45/02; B21B 45/0203; B21B 45/0215;
(Continued)

(56) References Cited

U.S. PATENT DOCUMENTS 4,371,149 A 2/1983 Takeuchi et al.
4,403,492 A 9/1983 Hope
(Continued)

FOREIGN PATENT DOCUMENTS

CN 102448632 A 5/2012
CN 102548680 A 7/2012
(Continued)

OTHER PUBLICATIONS

Taiwanese Office Action, dated Feb. 14, 2019, for corresponding Taiwanese Application No. 106126360 with a partial English translation.
(Continued)

*Primary Examiner* — Edward T Tolan
(74) *Attorney, Agent, or Firm* — Birch, Stewart, Kolasch & Birch, LLP.

(57) ABSTRACT

Provided is a cooling device, where a hot-finish-rolling mill includes a plurality of nozzles which spray cooling water toward one of or both of upper and lower surfaces of a hot-rolled steel sheet just after rolled by rolling stands, the nozzles are provided on the inside of the upper and lower guides or adjoining to the guides on a downstream side, and a nozzle spray distance changes depending on a position of the nozzle in a rolling direction, wherein a spray angle of the nozzle at a position whose nozzle spray distance is the
(Continued)

largest is smaller than a spray angle of the nozzle at a position whose nozzle spray distance is the smallest, and the spray angle of the nozzle becomes the same or smaller as the nozzle spray distance becomes large.

14 Claims, 11 Drawing Sheets

(51) Int. Cl.
*B21B 38/00* (2006.01)
*C21D 1/667* (2006.01)
*C21D 8/02* (2006.01)

(52) U.S. Cl.
CPC ..... *B21B 45/0218* (2013.01); *C21D 1/667* (2013.01); *C21D 8/0263* (2013.01); *B21B 2261/20* (2013.01); *C21D 2211/00* (2013.01)

(58) Field of Classification Search
CPC . B21B 37/76; B22D 11/1246; B21D 45/0203; B21D 45/0209; B21D 45/0215; B21D 45/0218; B21D 45/0233; C21D 1/667; C21D 9/0062
USPC ..... 72/201; 266/46, 113
See application file for complete search history.

(56) References Cited

U.S. PATENT DOCUMENTS

| | | | | | |
|---|---|---|---|---|---|
| 4,751,960 | A * | 6/1988 | Naveau | B22D 11/128 164/486 |
| 4,785,646 | A * | 11/1988 | Uekaji | B21B 37/44 72/201 |
| 5,259,229 | A * | 11/1993 | Inagaki | C21D 9/0068 239/562 |
| 6,054,095 | A * | 4/2000 | Minato | C21D 9/573 266/46 |
| 7,718,018 | B2 * | 5/2010 | Serizawa | B21B 37/74 148/661 |
| 8,440,133 | B2 * | 5/2013 | Eto | B21B 45/0218 266/113 |
| 8,500,927 | B2 * | 8/2013 | Tachibana | B21B 37/76 148/511 |
| 8,881,568 | B2 * | 11/2014 | Nakata | B21B 45/0233 72/201 |
| 9,039,956 | B2 * | 5/2015 | Matsumoto | B21B 39/16 266/46 |
| 2003/0034593 | A1 * | 2/2003 | Lee | C21D 8/0278 266/115 |
| 2009/0194207 | A1 | 8/2009 | Oda | |
| 2010/0192658 | A1 | 8/2010 | Ueoka et al. | |
| 2012/0068391 | A1 | 3/2012 | Eto et al. | |
| 2012/0216923 | A1 | 8/2012 | Tachibana et al. | |
| 2015/0101386 | A1 * | 4/2015 | Nikaido | B21B 45/0233 72/342.2 |
| 2015/0328670 | A1 * | 11/2015 | Alken | B05B 12/12 72/12.2 |

FOREIGN PATENT DOCUMENTS

| | | | | | |
|---|---|---|---|---|---|
| CN | 102639262 | A | | 8/2012 | |
| CN | 102834193 | A | | 12/2012 | |
| DE | 2543750 | A1 | * | 4/1976 | B21B 45/02 |
| DE | 3704599 | A1 | * | 8/1988 | B21B 45/0233 |
| EP | 2 540 407 | A1 | | 1/2013 | |
| JP | 55-70410 | A | | 5/1980 | |
| JP | 60-77932 | A | | 5/1985 | |
| JP | 62-21413 | A | | 1/1987 | |
| JP | 63-126611 | A | * | 5/1988 | B21B 45/0218 |
| JP | 4-200816 | A | | 7/1992 | |
| JP | 2001-246412 | A | | 9/2001 | |
| JP | 2003-305502 | A | | 10/2003 | |
| JP | 2004-306064 | A | | 11/2004 | |
| JP | 2005-59038 | A | | 3/2005 | |
| JP | 2005059038 | A | * | 3/2005 | |
| JP | 2005-279736 | A | | 10/2005 | |
| JP | 2008-43988 | A | | 2/2008 | |
| JP | 2008-110353 | A | | 5/2008 | |
| JP | 2009-241113 | A | | 10/2009 | |
| JP | 2009-241114 | A | | 10/2009 | |
| JP | 2009-241115 | A | | 10/2009 | |
| JP | 2010-516473 | A | | 5/2010 | |
| JP | 2011-11221 | A | | 1/2011 | |
| JP | 2011011221 | A | * | 1/2011 | |
| JP | 4870110 | B2 | | 2/2012 | |
| JP | 2014-50878 | A | | 3/2014 | |
| JP | 2014050878 | A | * | 3/2014 | |
| JP | 5663848 | B2 | | 2/2015 | |
| KR | 10-2012-0023692 | A | | 3/2012 | |
| SU | 910266 | A1 | * | 3/1982 | B21B 45/0233 |
| SU | 1600889 | A1 | * | 10/1990 | B21B 45/0233 |
| TW | 201607634 | A | | 3/2016 | |
| WO | WO 2011/065290 | A1 | | 6/2011 | |
| WO | WO 2012/011578 | A1 | | 1/2012 | |

OTHER PUBLICATIONS

International Preliminary Report on Patentability and English Translation of Written Opinion of the International Searching Authority for PCT/JP2017/033248;(Forms PCT/IB/373 and PCT/ISA/237) dated Mar. 26, 2019.
Chinese Office Action and Search Report dated Feb. 3, 2020, for corresponding Chinese Application No. 201780057160.1.
Extended European Search report dated Jan. 21, 2020, for corresponding European Application No. 17852941.8.
Japanese Office Action dated Jan. 7, 2020 for corresponding Japanese Application No. 2018-541011, with English translation.
International Search Report for PCT/JP2017/033248 dated Oct. 24, 2017.
Office Action for TW 106131931 dated Nov. 21, 2018.
Written Opinion of the International Searching Authority for PCT/JP2017/033248 (PCT/ISA/237) dated Oct. 24, 2017.

* cited by examiner

COOLING DEVICE AND COOLING METHOD OF HOT-ROLLED STEEL SHEET

TECHNICAL FIELD

The present invention relates to a cooling device and a cooling method of a hot-rolled steel sheet which is finish-rolled with a hot-finish-rolling mill formed of a plurality of stands, and particularly to a cooling technology for material control when a high-functional steel product is manufactured.

BACKGROUND ART

When a hot-rolled steel sheet is manufactured, a cast slab (slab) manufactured by a continuous casting machine or the like is subjected to heating by a heating furnace to have a rough-rolled steel product (rough bar) by a roughing mill, subsequently subjected to finish-rolling by a finishing mill to have a steel sheet with a predetermined sheet thickness, and further, the steel sheet is subjected to cooling with a predetermined cooling pattern to have a hot-rolled steel sheet. In the finishing mill, a plurality of rolling stands are arranged in series, and the rough-rolled steel product is finish-rolled by sequentially passing through the plurality of rolling stands.

It is known that when the hot-rolled steel sheet is manufactured, the steel sheet is subjected to rapid-cooling just after the finish-rolling is finished, resulting in that a grain size of each steel sheet crystal grain is refined and a hot-rolled steel sheet excellent in mechanical properties can be manufactured. That is, for example, the finish-rolling is finished at an $Ar_3$ transformation point or more, the cooling is started within 0.1 to 0.2 seconds just after the rolling to rapidly cool to a temperature of less than the $Ar_3$ transformation point to thereby suppress growth of crystals of the hot-rolled steel sheet after the finish-rolling, enable refining of crystals, and to improve material characteristics such as deep drawability of a final product. The rapid cooling from just after the finish-rolling can be performed through water-cooling where water is sprayed on the steel sheet just after the finish-rolling is finished.

Conventional cooling between the rolling stands in the finishing mill has been performed in order to improve a temperature distribution in the steel sheet due to the heating furnace, nonuniform expansion in a width direction of a reduction roll, and the like, and to prevent temperature increase due to increase in heat generation by processing during the finish-rolling, and the steel sheet temperature was cooled by approximately 20° C. when passing between the rolling stands. Cooling capacity of the cooling to this extent is insufficient to suppress the growth of the crystal grain size. In addition, a cooling device is necessary to be provided at a position as close as possible to the rolling stands in order to start the cooling just after the rolling.

Patent Document 1 discloses that steel sheet cooling devices each equipped with full cone spray nozzles or the like spraying cooling water are provided between finish-rolling stands, rapid-cooling just after rolling is performed by the steel sheet cooling device between preceding finish-rolling stands, and the rapid-cooling in a temperature zone including the $Ar_3$ transformation point is performed by the steel sheet cooling device between subsequent finish-rolling stands, and a temperature zone passing through the finish-rolling stand sandwiched between the two steel sheet cooling devices is set to a temperature zone from the $Ar_3$ transformation point +20° C. to the $Ar_3$ transformation point.

Patent Document 2 discloses that a cooling device is provided between finish-rolling stands, reduction rolls of the finish-rolling stand on a downstream side of the cooling device are opened to thereby avoid soft-reduction after performing rapid-cooling just after rolling.

Patent Document 3 discloses a steel sheet cooling device which is disposed on an exit side of a finish-rolling stand. This cooling device is equipped with a cooling box whose inside is a storage tank of cooling water, and spray nozzles spraying the cooling water are disposed in the cooling box.

Patent Document 4 discloses that when a cooling device formed of a plurality of cooling boxes is disposed on an exit side of a finishing mill to continuously cool a steel strip running on a hot-run table, the steel strip is cooled by setting a water volume density when each cooling box is used at a constant value of 2500 L/min·m$^2$ or more, and by using 80% or more of the total number of cooling boxes held by the cooling device at a maximum cooling time of the steel strip over a whole length of the steel strip.

Patent Document 5 describes that in hot-rolling, cooling between stands of a finishing mill is performed, rolling after the cooling is performed at a reduction ratio to the extent that a refined crystal grain size does not become coarse again, and a most downstream side stand is a draining stand which does not perform substantial rolling.

Patent Document 6 discloses a cooling device where a box header is provided between an exit side of a lower apron on an exit side of a lower work roll and an entry side of a looper roll, and a nozzle plate which is also used as an apron where a lot of drill holes for spraying cooling water are arranged on an upper surface of the box header is attached as the cooling device cooling a lower surface of a steel sheet during hot-rolling.

Patent Document 7 discloses that a cooling device equipped with a plurality of nozzles spraying cooling water toward an upper surface of a steel sheet and a plurality of nozzles spraying cooling water toward a lower surface of the steel sheet is disposed on a lower process side (an exit side) of a finishing mill, and when a maximum collision pressure of the cooling water sprayed from the upper surface side nozzles on the steel sheet upper surface is set as $P_{C1}$ (kPa), a minimum collision pressure is set as $P_{C2}$ (kPa), and an average collision pressure is set as $P_S$ (kPa), $(P_{C1}-P_{C2})/P_S \geq 1.4$ is satisfied.

Patent Document 8 discloses a cooling device equipped with an upper surface cooling box which performs cooling by spraying cooling water toward an upper surface of a steel strip and a lower surface cooling box which performs cooling by spraying cooling water toward a lower surface of the steel strip, and the cooling water is up-down symmetrically sprayed toward the steel strip from the upper surface cooling box and the lower surface cooling box at a position closest to an exit side of a finishing mill.

Patent Document 9 discloses a cooling device equipped with an upside spray bar (a plurality of spray nozzles) which is provided adjoining to a guide on an upper side of a strip and spraying cooling water toward an upper surface of the strip and a downside spray bar (a plurality of spray nozzles) which is provided adjoining to a guide on a lower side of the strip and spraying cooling water toward a lower surface of the strip on an exit side of a roll stand.

PRIOR ART DOCUMENT

Patent Document

[Patent Document 1] Japanese Laid-open Patent Publication No. 2009-241115

[Patent Document 2] Japanese Laid-open Patent Publication No. 2009-241113

[Patent Document 3] Japanese Laid-open Patent Publication No. 2009-241114 [Patent Document 4] Japanese Laid-open Patent Publication No.

2005-279736

[Patent Document 5] Japanese Laid-open Patent Publication No. 2003-305502

[Patent Document 6] Japanese Laid-open Patent Publication No. H4-200816

[Patent Document 7] Japanese Laid-open Patent Publication No. 2014-50878

[Patent Document 8] Japanese Laid-open Patent Publication No. 2001-246412

[Patent Document 9] Japanese Translation of PCT International Application Publication No. JP-T-2010-516473

DISCLOSURE OF THE INVENTION

Problems to be Solved by the Invention

It is desirable that a steel sheet is strongly cooled as soon as possible just after rolling and from a position as close as possible to the steel sheet in order to suppress coarsening of a crystal grain size. However, a cooling device has to be disposed so as not to collide with the steel sheet after the rolling. Besides, a guide is normally provided on an exit side of a rolling stand, and the guide is necessary to be retreated to a position apart from a reduction roll when the reduction roll is replaced. At this time, when the cooling device is separately disposed close to the guide, there are problems that it takes time for a work to retreat the cooling device, and that the cooling device is forced to be disposed at a place apart from the rolling mill and the steel sheet. In addition, it is necessary to dispose a cooling device for the reduction roll at the guide on an opposite side of the steel sheet, and a structure of the cooling device becomes a problem. When the cooling device is provided at a final stage of a finishing mill, a sheet thickness measurement device and a sheet temperature measurement device subsequent to the finishing mill are necessary, and a length of the cooling device is not preferably made long in order to properly manage the sheet thickness and the sheet temperature.

However, none of Patent Documents 1 to 5 describe regarding a concrete attaching structure of the cooling device. Patent Document 6 mentions the cooling device only at the lower part of the steel sheet, and the cooling device and the lower apron are separated. In the cooling device disclosed in Patent Document 7, the nozzles are disposed along the guide, but the nozzles and the guide are separated. Further, there is a possibility that the reduction roll is deformed due to heat received from the steel sheet and a shape of the steel sheet deteriorates because the cooling device for the reduction roll cannot be provided according to the above disposition.

In the cooling device disclosed in Patent Document 8, the cooling boxes of the upper and lower surfaces are provided at the position closest to the exit side of the finishing mill and continuously to the guide. However, a length of the guide is several times or more of a diameter of the reduction roll (work roll), and a time until the cooling start becomes long, resulting in reducing a grain refining effect. There is no space to provide the sheet thickness measurement device, the sheet temperature measurement device, and the like which are normally provided after the finish-rolling before the cooling finishes, and management of highly accurate sheet thickness and material are difficult. In the cooling device disclosed in Patent Document 9, there is an interference when the guide is moved at the roll replace time, and it is difficult to dispose the cooling device at a position sufficiently close to the rolling mill. In addition, collision surfaces of the cooling water sprayed from the spray nozzles on the strip become nonuniform in a rolling direction because a distance between the spray nozzle and the strip changes in the rolling direction, resulting in occurrence of nonuniformity in cooling. In the cooling devices of other Patent Documents 1 to 7, a case when the steel sheet after the finish-rolling inclines is not considered, and the problem of nonuniformity in cooling also occurs.

The present invention is made in consideration of the aforementioned points, and an object thereof is to provide a cooling device and a cooling method of a hot-rolled steel sheet capable of cooling the steel sheet just after a hot-finish-rolling (including just after rolling by each rolling stand) from a position as close as possible to suppress growth of crystals of the hot-rolled steel sheet just after the finish-rolling to attain crystal grain refining, uniformly cooling the hot-rolled steel sheet, and simplifying labor at the reduction roll replace time.

Means for Solving the Problems

In order to solve the above-stated problems, the present invention is a cooling device characterized in that: including a plurality of nozzles which spray cooling water toward one of or both of upper and lower surfaces of a hot-rolled steel sheet just after rolled by rolling stands in a hot-finish-rolling mill formed of a plurality of rolling stands, wherein the nozzles are provided on the inside of one of or both of guides or adjoining to the guides on a downstream side between the guides provided at upper and lower sides on an exit side of the rolling stand, a steel sheet design position of the hot-rolled steel sheet which is set between the upper and lower guides is used as a reference, and a nozzle spray distance along a spray center axis from a spray port of the nozzle to the steel sheet design position changes depending on a position of the nozzle in a rolling direction, wherein a spray angle of the nozzle at a position whose nozzle spray distance is the largest is smaller than a spray angle of the nozzle at a position whose nozzle spray distance is the smallest, and the spray angle of the nozzle becomes the same or smaller as the nozzle spray distance becomes large.

The steel sheet design position may be set on a tangent plane (a definition thereof will be described later) at an upper vertex of a lower side reduction roll (work roll) of the rolling stand. The steel sheet design position may be set on a plane at ½ angle of an angle formed by the upper and lower guides.

The position whose nozzle spray distance is the smallest may be located on a most upstream side of the cooling device, and the position whose nozzle spray distance is the largest may be located on a most downstream side of the cooling device. The position whose nozzle spray distance is the largest may be located on a most upstream side of the cooling device, and the position whose nozzle spray distance is the smallest may be located on a most downstream side of the cooling device.

The nozzles may be provided on the inside of a cooling box. Spray ports of the nozzles of the cooling box may be located on the same plane as a surface on the steel sheet design position side or on a distant side (a center side of the cooling box) than the surface, and an end part of the nozzle on an opposite side of the spray port may protrude into the cooling box from an inner surface position on an inner side of the cooling box.

Spray ports of the nozzles may be disposed on the same plane as a plane formed by the guide. Spray ports of the nozzles may be disposed on an opposite side of the steel sheet design position than a plane formed by the guide.

The nozzle is a full cone nozzle, and a collision region of cooling water sprayed from the nozzle on the hot-rolled steel sheet may satisfy the following expression (1).

[Mathematical expression 1]

$$\left|1-\frac{(L_j\cdot\tan\alpha_j)^2}{(L_i\cdot\tan\alpha_i)^2}\right|\leq 0.10 \quad (1)$$

Where,

L: nozzle spray distance (m)

α: nozzle spray angle (degree)

i, j: arbitrary column (i column, j column) of nozzle provided in rolling direction The nozzle is a thickening flat spray nozzle, and a collision area of cooling water sprayed from the nozzle on the hot-rolled steel sheet may satisfy the following expression (2).

[Mathematical expression 2]

$$\left|1-\frac{(L_j\cdot\tan\beta_j)}{(L_i\cdot\tan\beta_i)}\right|\cdot\left|1-\frac{(L_j\cdot\tan\gamma_j)}{(L_i\cdot\tan\gamma_i)}\right|\leq 0.10 \quad (2)$$

Where,

L: nozzle spray distance (m)

β: nozzle major axis direction spray angle (degree)

γ: nozzle minor axis direction spray angle (degree)

j: arbitrary column (i column, j column) of nozzle provided in rolling direction A water volume density of cooling water from the nozzle may satisfy the following expression (3).

$$Wa^{0.5}\times Ma/(t\times V)\geq 0.08 \quad (3)$$

Where,

Wa: water volume density of cooling water from nozzle ($m^3/m^2\cdot min$)

Ma: cooling-span length in rolling direction at cooling device (m)

t: sheet thickness of hot-rolled steel sheet (mm)

V: sheet-passing speed of hot-rolled steel sheet (m/s)

A cooling zone including a plurality of cooling nozzles which spray cooling water toward one of or both of the upper and lower surfaces of the hot-rolled steel sheet is disposed on a downstream side of a measurement device which measures the hot-rolled steel sheet on the exit side of the rolling stand on the most downstream side of the hot-finish-rolling mill, a water volume density of the cooling water from the cooling nozzle is 2 $m^3/m^2\cdot min$ or more, and may satisfy the following expression (4).

$$Wb^{0.5}\times Mb/(t\times V)\geq 0.55 \quad (4)$$

Where,

Wb: water volume density of cooling water from cooling nozzle ($m^3/m^2\cdot min$)

Mb: cooling-span length in rolling direction at cooling zone (m)

t: sheet thickness of hot-rolled steel sheet (mm)

V: sheet-passing speed of hot-rolled steel sheet (m/s)

The cooling device is disposed between the rolling stands, reduction rolls of the rolling stand on a downstream side than the cooling device are opened, a roll gap of the reduction roll (work roll) is set to a value where 7 mm is added to an aimed sheet thickness or less, and a water spray device which removes water on the sheet leaking out of the rolling stand on the most downstream side may be disposed on the exit side of the rolling stand on the most downstream side of the hot-finish-rolling mill.

The cooling device is disposed on the exit side of the rolling stand on the most downstream side of the hot-finish-rolling mill, and a water spray device which removes water on the sheet running out of the cooling device may be disposed on the downstream side of the cooling device.

The plurality of nozzles are arranged in a width direction to form columns, and the predetermined number of columns are put together in the rolling direction to form a plurality of nozzle groups arranged in the rolling direction, the maximum number of the plurality of nozzle groups is the same as the number of columns in the rolling direction of the nozzles provided in the rolling direction, a pipe where cooling water is supplied is connected to each of the nozzle groups, and a three-way valve and a flow rate regulating valve may be provided at each pipe.

Another aspect of the present invention is a cooling method using the cooling device, characterized in that including: spraying cooling water from nozzles toward one of or both of upper and lower surfaces of a hot-rolled steel sheet on an exit side of a rolling stand of a hot-finish-rolling mill.

Still another aspect of the present invention is a cooling method using the cooling device, characterized in that including: when cooling water is sprayed from nozzles toward one of or both of upper and lower surfaces of a hot-rolled steel sheet on an exit side of a rolling stand of a hot-finish-rolling mill, adjusting the number of nozzle groups in a rolling direction spraying cooling water toward the hot-rolled steel sheet in accordance with a sheet-passing speed of the hot-rolled steel sheet; increasing the number of nozzle groups spraying the cooling water toward the hot-rolled steel sheet from a closer side to a farther side from the rolling stand in sequence when the sheet-passing speed increases, and stopping the spraying from the nozzles in the nozzle groups toward the hot-rolled steel sheet and letting the cooling water flow toward a drain side from a farther side from the rolling stand in sequence when the sheet-passing speed decreases.

Effect of the Invention

According to the present invention, a hot-rolled steel sheet just after passing through rolling stands can be cooled from a position close thereto by providing a plurality of nozzles on the inside of an existing guide or adjoining to the guide on a downstream side which is provided on an exit side of the rolling stand. It is thereby possible to suppress growth of a crystal grain size of the hot-rolled steel sheet after finish-rolling to enable grain refining, and to manufacture a high-quality steel sheet at a low cost. When a nozzle spray distance changes depending on a position of a nozzle in a rolling direction, a spray angle of a nozzle at a position whose nozzle spray distance is the largest is smaller than a spray angle of a nozzle at a position whose nozzle spray distance is the smallest, and the spray angle of the nozzle becomes the same or smaller as the nozzle spray distance becomes larger, resulting in that a collision surface can be made uniform in the rolling direction, cooling capacity can be made uniform, and as a result, the hot-rolled steel sheet can be uniformly cooled in the present invention. In addition, in the cooling device of the present invention, a retreating work at the reduction roll replace time does not take time.

BEST MODE FOR CARRYING OUT THE INVENTION

Figure 1:
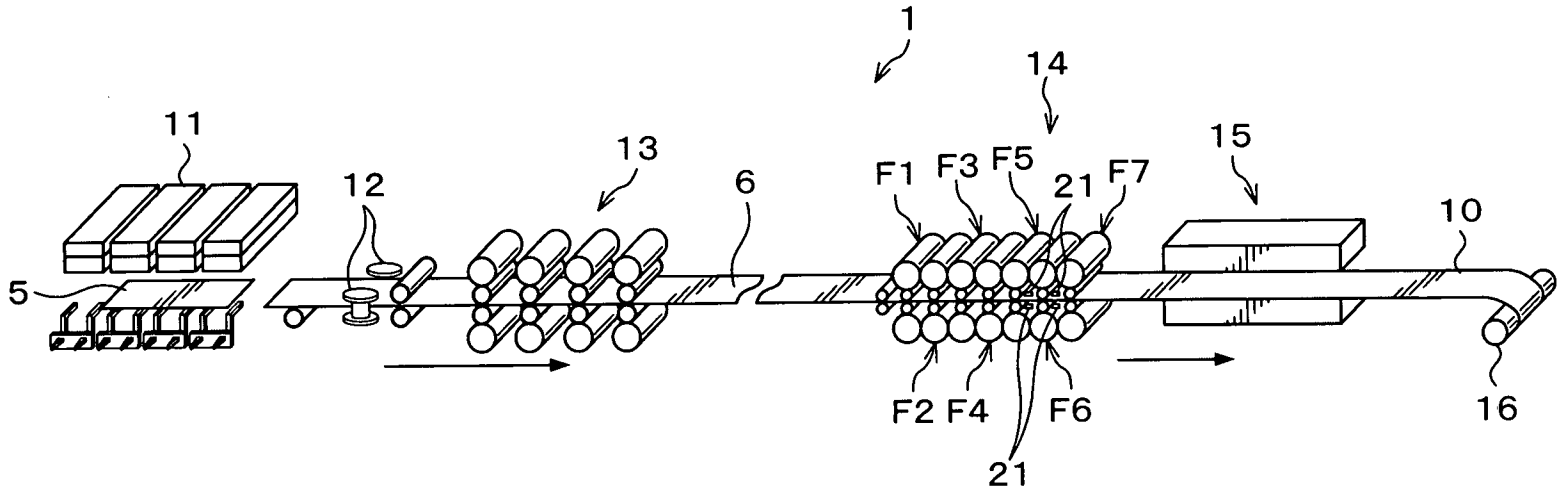
FIG. 1 A view illustrating a schematic configuration of hot-rolling equipment equipped with a cooling device according to an embodiment of the present invention.

The following describes embodiments of the present invention with reference to the drawings. Incidentally, a redundant description is avoided as for elements each having substantially the same functional constitution by supplying the same reference numerals in the present description and the drawings.

First, hot-rolling equipment equipped with a cooling device according to this embodiment is described. FIG. 1 is an explanatory view illustrating a schematic configuration of hot-rolling equipment 1.

In the hot-rolling equipment 1, a heated slab 5 is continuously rolled, and a hot-rolled steel sheet 10 whose sheet thickness is reduced to approximately 1 to 20 mm is winded. As illustrated in FIG. 1, the hot-rolling equipment 1 is equipped with a heating furnace 11 which heats the slab 5, a width direction rolling mill 12 which rolls the slab 5 heated by the heating furnace 11 in a width direction, a roughing mill 13 which rolls the slab 5 rolled in the width direction from up and down directions to make it a rough bar 6, a finishing mill 14 which performs continuous hot-finish-rolling on the rough bar 6 to further reduce to a predetermined thickness, a cooling part 15 which cools the hot-rolled steel sheet 10 hot-finish rolled by the finishing mill 14 to a predetermined temperature, and a winding device 16 which winds up the hot-rolled steel sheet 10 cooled by the cooling part 15 into a coil state. The hot-rolling equipment 1 has a general equipment configuration, and the hot-rolling equipment where the present invention is applied is not limited thereto.

The heating furnace 11 is equipped with various burners to heat the slab 5. In the heating furnace 11, a process heating the slab 5 carried from outside to a predetermined temperature is performed. When the heating process at the heating furnace 11 is finished, the slab 5 is conveyed to the outside of the heating furnace 11, and transferred to a rolling process by the width direction rolling mill 12 and the roughing mill 13.

In the roughing mill 13, cylindrical reduction rolls are disposed over a plurality of stands. The reduction rolls include a work roll where a material to be rolled is directly sandwiched and a backup roll which suppresses or controls deflection of the work roll. In the roughing mill 13, the conveyed slab 5 passes through a gap between these reduction rolls (work rolls), rolled to have a sheet thickness of approximately 30 to 60 mm, and then convened to the finishing mill 14.

In the finishing mill 14, a plurality of, for example, seven rolling stands F1 to F7 each equipped with the reduction rolls are disposed in series. The reduction rolls include work rolls where a material to be rolled is directly sandwiched and backup rolls which suppress or control deflection of the work rolls, and an intermediate roll may be sandwiched therebetween in a special case. In the cooling device of the present invention, the reduction roll mainly indicates the work roll, but on rare occasions, the reduction roll may be used as a generic name including the backup roll. In the finishing mill 14, the rough bar 6 after the rough-rolling is passed through the gap between these reduction rolls (work rolls), gradually rolled, and rolled to have a sheet thickness of approximately 1 to 20 mm (for example, a sheet thickness of approximately several mm) The finish-rolled hot-rolled steel sheet 10 is conveyed by a not-illustrated conveyor roll to be transferred to the cooling part 15.

In the cooling part 15, a plurality of cooling nozzles each spraying cooling water toward the hot-rolled steel sheet 10 are arranged and disposed in a rolling direction at an upper side and a lower side of the conveyed hot-rolled steel sheet 10. Examples of the cooling nozzle include, for example, a slit-laminar nozzle, a pipe laminar nozzle, and a spray nozzle.

The winding device 16 winds up the hot-rolled steel sheet 10 which is cooled to the predetermined temperature by the cooling part 15. The hot-rolled steel sheet 10 which is winded in the coil state by the winding device 16 is conveyed to the outside of the hot-rolling equipment 1.

In the present invention, a cooling device 21 which strongly cools the hot-rolled steel sheet 10 just after the finish-rolling is provided on an exit side of the rolling stand in addition to the cooling part 15. The exit side of the rolling stand is a position between the rolling stands F1 to F7 arranged in plural or a position on a downstream side of the final rolling stand F7, and the cooling device 21 is preferably provided on the exit side of the rolling stand at a subsequent stage which is close to the final rolling stand F7 of the finishing mill 14 in order to cool the hot-rolled steel sheet 10 after it is sufficiently finish-rolled. In this embodiment, the finishing mill 14 includes the seven rolling stands F1 to F7, and the cooling devices 21 are disposed at two positions of, for example, between F5 and F6 and between F6 and F7. Here, the strong cooling means the cooling where, for example, a cooling rate is 50° C./s or more, and a steel sheet temperature decreases by 30° C. or more by passing through one cooling device 21.

Figure 2:
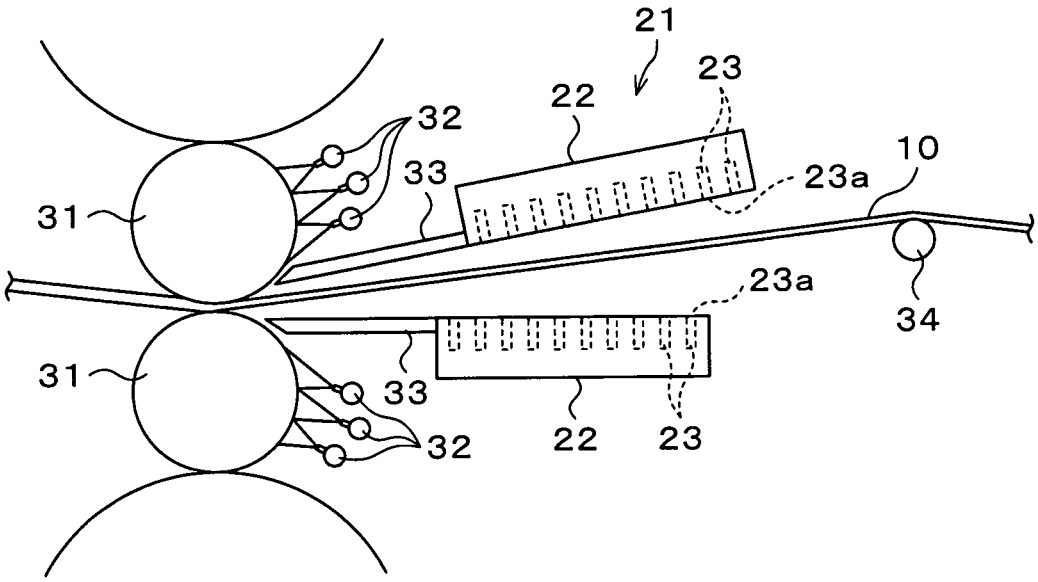
FIG. 2 A side view illustrating a schematic configuration of a finish-rolling stand on an exit side provided with a cooling device according to the present embodiment.

FIG. 2 illustrates a schematic configuration of the rolling stand on the exit side where the cooling device 21 of this embodiment is provided. A distance between upper and lower guides 33 (a distance in a vertical direction) becomes large from an upstream side toward a downstream side in the rolling direction. The upper and lower guides 33 are disposed in this way so that the hot-rolled steel sheet 10 does not collide with facilities provided at an upper side and a lower side of the hot-rolled steel sheet 10 even when a head of the hot-rolled steel sheet 10 flaps vertically. The cooling device 21 according to this embodiment is provided at a tip part of each of the upper and lower guides 33. The guide 33 is sometimes called a stripper guide, but it is called just a guide in the present invention.

Figure 3:
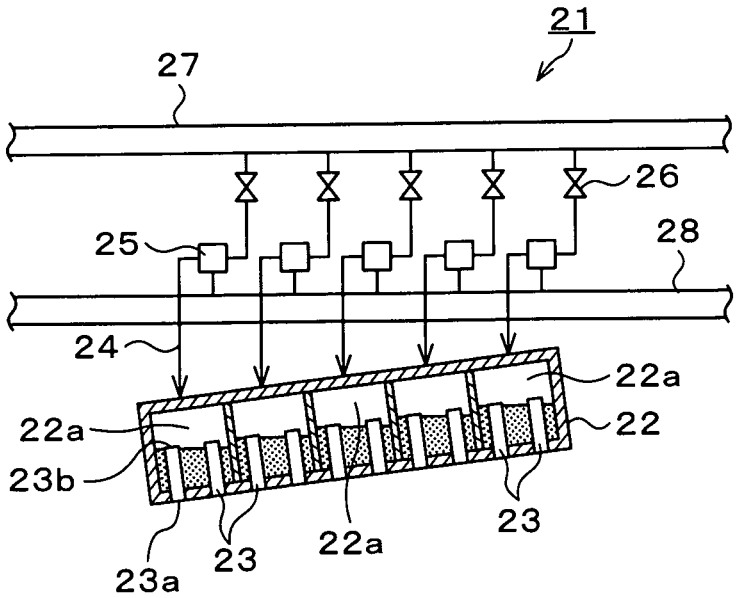
FIG. 3 A view illustrating a schematic configuration of a cooling device according to the present embodiment.

The cooling device 21 includes a cooling box 22 formed of a hermetic container, a plurality of nozzles 23 provided in the cooling box 22, and pipes 24 which supply cooling water to the cooling box 22, as illustrated in FIG. 3. The cooling box 22 is integrally provided at a tip part on a side getting away from the reduction roll (work roll) 31 of each of the upper and lower guides 33 as illustrated in FIG. 2. The cooling box 22 is preferably provided at a position as close as possible to the rolling stand and as close as possible to the hot-rolled steel sheet 10 (a steel sheet design position) so that the hot-rolled steel sheet 10 is cooled just after passing through the rolling stand, and the cooling box 22 is provided just after roll cooling water headers 32 as illustrated in FIG. 2. The steel sheet design position of the hot-rolled steel sheet 10 is set when the cooling device 21 is designed, is a position where the hot-rolled steel sheet 10 passes, and determined in consideration of, for example, a sheet-passing angle or the like of the hot-rolled steel sheet 10 in a steady state between the upper and lower guides 33. A concrete determination method of the steel sheet design position is described later.

The plurality of nozzles 23 spraying cooling water toward the hot-rolled steel sheet 10 are equipped in the cooling box 22. A full cone nozzle or a thickening flat spray nozzle is used as the nozzle 23, and the plurality of nozzles 23 are respectively provided in the width direction and the rolling direction of the cooling box 22 such that a spray surface and the guide 33 are on the same plane. The spray surface is a surface formed of spray ports 23*a* of the plurality of nozzles, and is a surface to be a lower surface in a case of the cooling box 22 provided at an upper part of the steel sheet design position, and to be an upper surface in a case of the cooling box 22 provided at a lower part of the steel sheet design position.

As illustrated in FIG. 3, the spray ports 23*a* of the nozzles 23 may be located on the same plane as the surface on the steel sheet design position side of the cooling box 22 or on a distant side (a center side of the cooling box 22) than the surface. The nozzles 23 are disposed at the surface on the steel sheet design position side of the cooling box 22. At this time, the spray port 23*a* of each nozzle 23 does not protrude from the surface on the steel sheet design position side, and is located on the same plane as the surface or on the distant side than the surface. That is, the spray port 23*a* of the nozzle 23 is disposed at the same plane as the surface on the steel sheet design position side or to be hollowed from the surface. In such a case, even if head and tail of the hot-rolled steel sheet 10 flap vertically to collide with the cooling box 22 when the head and the tail pass through the rolling stand in the finish-rolling, the hot-rolled steel sheet 10 does not collide with the nozzles 23, resulting in that damages on the nozzles 23 can be prevented.

An end part 23*b* of the nozzle 23 on an opposite side of the spray port 23*a* protrudes into the cooling box 22 than an inner surface position on an inner side of the cooling box 22. In such a case, the nozzle 23 is cooled by the cooling water remaining in the cooling box 22 even when the nozzle 23 does not spray the cooling water, resulting in that damages on the nozzle 23 can be prevented. In addition, when the spray of the cooling water from the nozzle 23 is turned ON/OFF, it becomes possible to shorten a response time from a state where the spray of the cooling water is stopped until the spray of the cooling water is started because there is remaining water in the cooling box 22. It is possible to reduce an amount of cooling water dropping on the hot-rolled steel sheet 10 after water feeding is stopped to stop the spray of the cooling water from the nozzle 23, resulting in that a response time until the spray of the cooling water is substantially stopped can be shortened.

As illustrated in FIG. 3, an inside of the cooling box 22 is divided into a plurality of sections 22*a* in the rolling direction. The pipe 24 where the cooling water is supplied is provided at each section 22*a*, and a three-way valve 25 and a flow rate regulating valve 26 are provided with respect to each pipe 24. The three-way valve 25 is provided between a feedwater header 27 which supplies the cooling water to the cooling box 22 and a drain header 28 which drains the cooling water or a drain area. In FIG. 3, the inside of the cooling box 22 is divided such that two columns of nozzles 23 in the rolling direction are put into one section 22*a*, but may be divided such that one column of nozzles 23 in the rolling direction are put into one section 22*a*, or three columns or more of nozzles 23 in the rolling direction are put into one section 22*a*. The sections 22*a* are each sectioned by the predetermined number of nozzles 23, to form a nozzle group in the present invention. The inside of the cooling box 22 may be one section 22*a* without being divided into the plurality of sections 22*a*.

Figure 16:
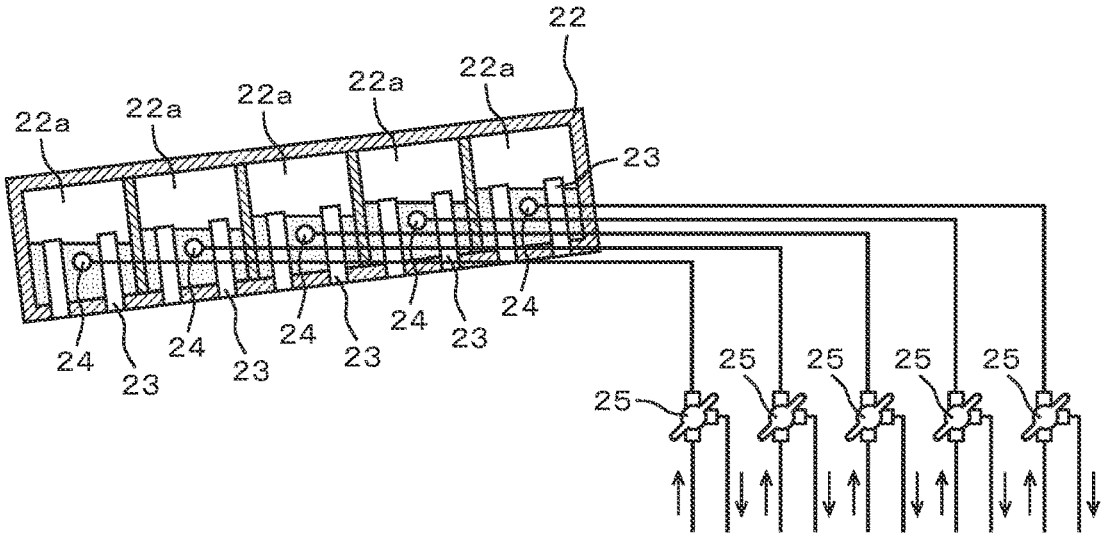
FIG. 16 illustrates a configuration of a cooling device at an upper surface side of a hot-rolled steel sheet.
Figure 17:
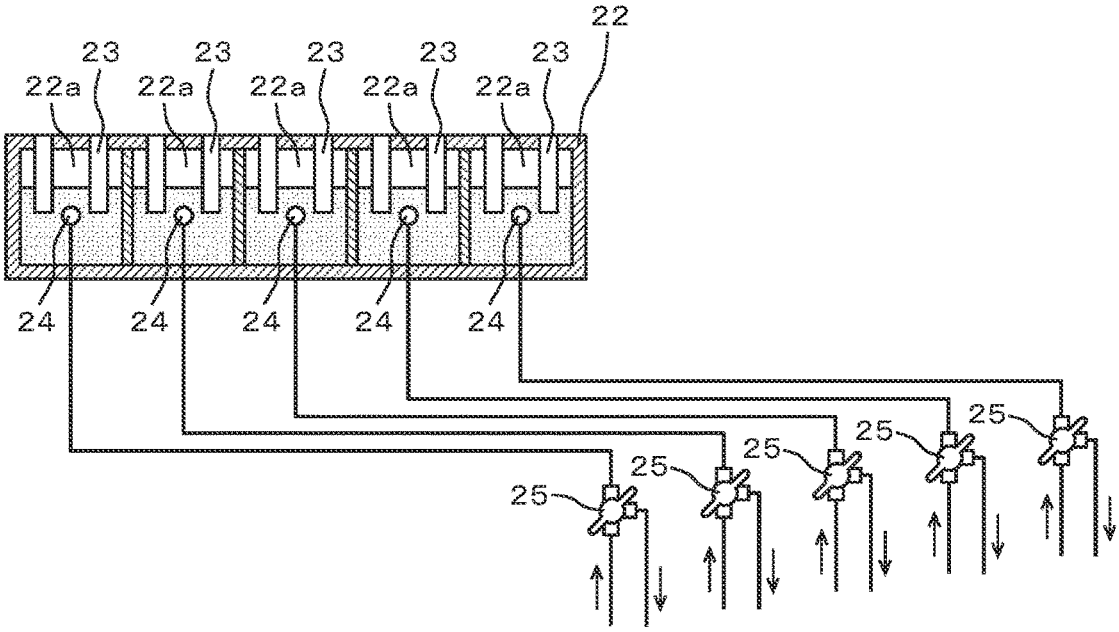
FIG. 17 illustrates another configuration of a cooling device at a lower surface side of a hot rolled steel sheet.

The three-way valve 25 provided at the pipe 24 enables that the inside of the pipe 24 is constantly filled with the cooling water. When the hot-rolled steel sheet 10 is cooled, a required time from an instruction to open the three-way valve 25 is issued until the cooling water is supplied into the cooling box 22 is short, and responsiveness thereof is good. For example, an electromagnetic valve is used as the three-way valve 25. The three-way valve 25 is preferably disposed at a height slightly lower than an upper end of the nozzle 23. A tip of the pipe 24 thereby has a height slightly lower than the upper end of the nozzle 23, resulting in that the cooling water is constantly filled in the pipe 24. Although it is not illustrated in FIG. 3, see FIGS. 16 and 17.

Figure 4:
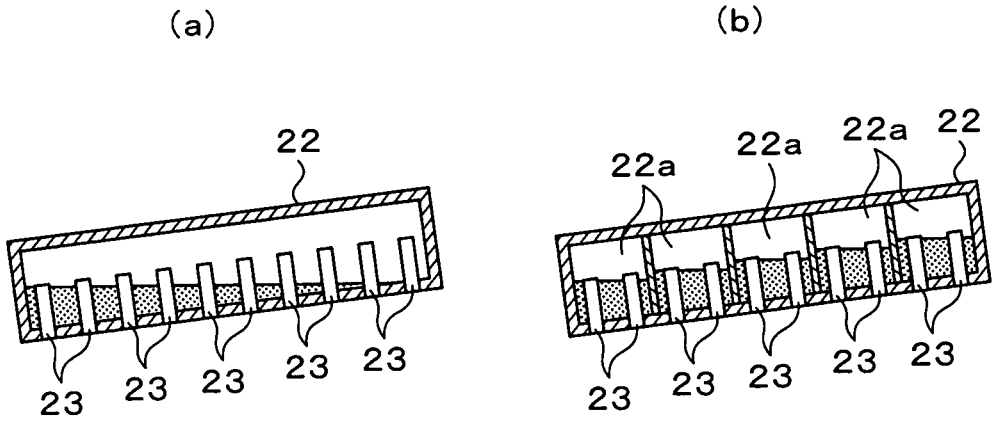
FIGS. 4 Views each explaining retention of water in a cooling box at a standby time, where (a) illustrates a case when the cooling box is not divided, and (b) illustrates a case when the cooling box is divided into a plurality of sections.

The inside of the cooling box 22 is divided into the plurality of sections 22*a* in the rolling direction, and the pipe 24 is provided at each section 22*a*, resulting in that a flow rate of the cooling water can be regulated by each section 22*a* and cooling capacity can be controlled with correspond to change in a wide range of a sheet-passing speed of the hot-rolled steel sheet 10. An amount of remaining water which can be retained in the cooling box 22 during standby becomes large, and a response speed until the spray start of the cooling water can be accelerated. When the cooling box 22 is provided in a direction along the guide 33, for example, the cooling box 22 provided at the tip of the upper guide 33 inclines as illustrated in FIG. 4. When the inside of the inclined cooling box 22 is not divided and all nozzles 23 are disposed in one space, water can be retained only up to a position lower than the upper end of the nozzle 23 located at the lowest position as illustrated in FIG. 4(*a*) when the cooling water is not sprayed. It takes a response time from this state until water is supplied to a position higher than the upper end of the nozzle located at the highest position in order to spray the cooling water from all nozzles 23. However, water can be retained up to a position lower than the upper end of the lower nozzle 23 by each section 22*a* as illustrated in FIG. 4(*b*) by dividing the inside of the cooling box 22 in the rolling direction. Accordingly, when the spray is started, the spraying from all nozzles 23 is started by supplying less cooling water, and the responsiveness is improved. When the cooling box 22 is divided in the rolling direction such that one section 22*a* includes one column of the nozzles 23, water can be retained up to a position slightly lower than the upper ends of all nozzles 23, and the responsiveness at the spraying time can be improved.

Figure 5:
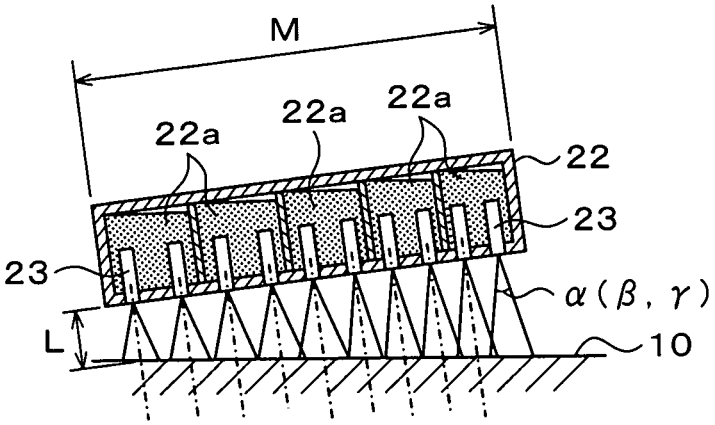
FIG. 5 A view explaining a spray angle of a nozzle in accordance with a nozzle spray distance.

Here, a distance from the tip (the spray port 23*a*) of the nozzle 23 to the steel sheet design position of the hot-rolled steel sheet 10 along a spray center axis (a dot and dash line in the drawing) is defined as a nozzle spray distance L as illustrated in FIG. 5. The nozzle spray distances L differ in the rolling direction of the cooling box 22 because the cooling box 22 inclines as stated above. That is, the nozzle spray distance L becomes large as the position of the nozzle 23 is far from the rolling stand, and a position whose nozzle spray distance L is the smallest is located on the most upstream side of the cooling device 21, and a position whose nozzle spray distance L is the largest is located on the most downstream side of the cooling device 21. When spray angles of all nozzles 23 are set to be equal, a spread of a jet flow collision part when the cooling water hits on the hot-rolled steel sheet 10 becomes larger as the cooling water is sprayed from a position apart from the hot-rolled steel sheet 10, and the cooling capacity decreases when the same amount of cooling water is sprayed. In addition, the jet flow collision parts are overlapped to cause nonuniformity in cooling. The spray angle of the nozzle 23 is therefore made small as the nozzle 23 is far from the rolling stand, that is, as the nozzle spray distance L becomes longer as illustrated in FIG. 5. In this embodiment, the guide 33 and the cooling box 22 at the upper part of the steel sheet design position are disposed to incline from the rolling direction, and the spray angle of the nozzle 23 is made small at the upper part, but the spray angle of the nozzle 23 at the lower part may also be made small.

Here, in the present invention, regarding the adjoining nozzles 23 in the rolling direction, it is not necessary that the spray angle of the nozzle 23 at the position whose nozzle spray distance L is the largest (on the downstream side in FIG. 5) is smaller than the spray angle of the nozzle 23 at the position whose nozzle spray distance L is the smallest (on the upstream side in FIG. 5). That is, in the present invention, the adjoining nozzles 23 in the rolling direction may have the same spray angle with each other as long as two conditions are simultaneously satisfied, where (1) the spray angle of the nozzle 23 at the position whose nozzle spray distance L is the largest is smaller than the spray angle of the nozzle 23 at the position whose nozzle spray distance L is the smallest, and (2) the spray angle of the nozzle 23 on the side whose nozzle spray distance L is smaller is not smaller than the spray angle of the nozzle 23 on the side whose nozzle spray distance L is larger with respect to the adjoining nozzles 23 in the rolling direction.

As the nozzle spray distance L becomes larger, the spray angle of the nozzle 23 is made smaller, and a difference in collision areas of the nozzle jet flows at arbitrary positions in the rolling direction, that is, a difference between a maximum collision area and a minimum collision area is set to 10% or less, resulting in that decrease of the cooling capacity when the collision area expands due to change in the distance between the tip of the nozzle 23 and the hot-rolled steel sheet 10 can be further suppressed, to make the cooling capacity at each position in the rolling direction constant. As a result, the hot-rolled steel sheet 10 can be more uniformly cooled.

Figure 6:
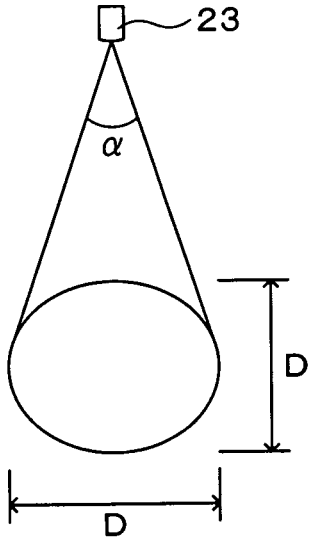
FIG. 6 An explanatory view illustrating a spray angle (a spread angle of a nozzle jet flow) from a full cone nozzle.

Concretely, when the nozzle 23 is the full cone nozzle, a spray angle α of the nozzle 23 is set such that a collision area of a nozzle jet flow (a collision area of the cooling water sprayed from the nozzle 23 at the hot-rolled steel sheet 10) satisfies the following expression (1). As illustrated in FIG. 6, the spray angle α of the nozzle 23 is a spread angle of the nozzle jet flow (a diameter D).

[Mathematical expression 3]

$$\left|1-\frac{(L_j\cdot\tan\alpha_j)^2}{(L_i\cdot\tan\alpha_i)^2}\right|\leq 0.10 \tag{1}$$

Figure 7:
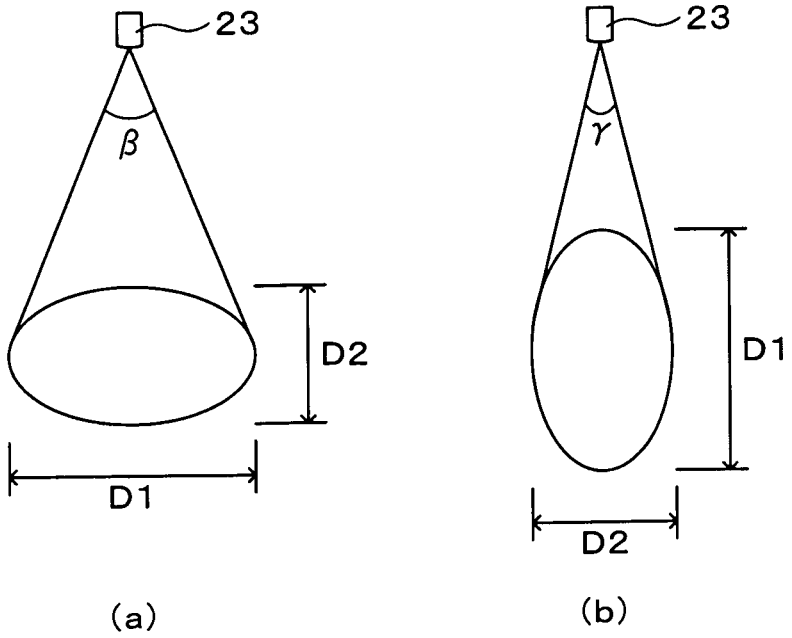
FIGS. 7 Explanatory views each illustrating a spray angle (a spread angle of a nozzle jet flow) from a thickening flat spray nozzle, where (a) illustrates a spray angle in a major axis direction, and (b) illustrates a spray angle in a minor axis direction.

Where,

L: nozzle spray distance (m)

α: nozzle spray angle (degree)

i, j: arbitrary column (i column, j column) of nozzle provided in rolling direction When the nozzle 23 is the thickening flat spray nozzle, a major axis direction spray angle β and a minor axis direction spray angle γ of the nozzle 23 are set such that the collision area of the nozzle jet flow satisfies the following expression (2). As illustrated in FIG. 7(*a*), the major axis spray angle β of the nozzle 23 is a spread angle of a major axis D1 of the nozzle jet flow, and as illustrated in FIG. 7(*b*), the minor axis spray angle γ of the nozzle 23 is a spread angle of a minor axis D2 of the nozzle jet flow.

[Mathematical expression 4]

$$\left|1-\frac{(L_j\cdot\tan\beta_j)}{(L_i\cdot\tan\beta_i)}\right|\cdot\left|1-\frac{(L_j\cdot\tan\gamma_j)}{(L_i\cdot\tan\gamma_i)}\right|\leq 0.10 \quad (2)$$

Figure 8:
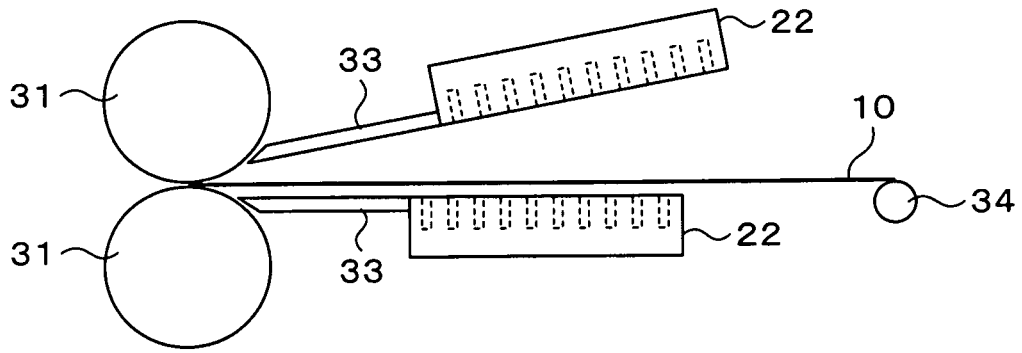
FIG. 8 An explanatory view illustrating a case when a sheet-passing angle (a steel sheet design position) of a hot-rolled steel sheet just after a finish-rolling stand is "0" (zero) degree.

Where,

L: nozzle spray distance (m)

β: nozzle major axis direction spray angle (degree)

γ: nozzle minor axis direction spray angle (degree)

i, j: arbitrary column (i column, j column) of nozzle provided in rolling direction By inclining a travel direction of the hot-rolled steel sheet 10 just after the finish-rolling stand with a looper 34, the hot-rolled steel sheet 10 is able to pass within a range from "0" (zero) degree being the rolling direction to an angle θ formed by the upper and lower guides 33 as illustrated in FIG. 8. That is, an angle of the steel sheet design position of the hot-rolled steel sheet 10 just after the finish-rolling stand exists between "0" (zero) degree to the angle θ. It is not easy to set a difference in the collision areas of the nozzle jet flows at arbitrary positions in the rolling direction, that is, the difference between the maximum collision area and the minimum collision area to fall within 10% or less regardless of a sheet-passing angle of the hot-rolled steel shet 10 just after the finish rolling stand, though it depends on the angle θ of the guides 33.

However, it is often the case when the sheet-passing angle of the hot-rolled steel sheet 10 just after the finish-rolling stand becomes approximately a constant angle under a steady state except for a start time, a finish time, and so on of the rolling. When the cooling device 21 is designed, the sheet-passing angle to be a prerequisite of the design is previously determined in consideration of the sheet-passing angle or the like in the steady state of the hot-rolled steel sheet 10. The position of the hot-rolled steel sheet 10 determined as stated above is the steel sheet design position in the present invention. When the hot-rolled steel sheet 10 exists in the previously determined sheet-passing angle, that is, the hot-rolled steel sheet 10 is in the sheet-passing angle in the steady state, the aforementioned difference can be made to be 10% or less. The difference can be made to be 10% or less when the hot-rolled steel sheet 10 is in the previously determined sheet-passing angle, that is, in the sheet-passing angle under the steady state, and the like resulting in that the hot-rolled steel sheet 10 can be more uniformly cooled.

Figure 9:
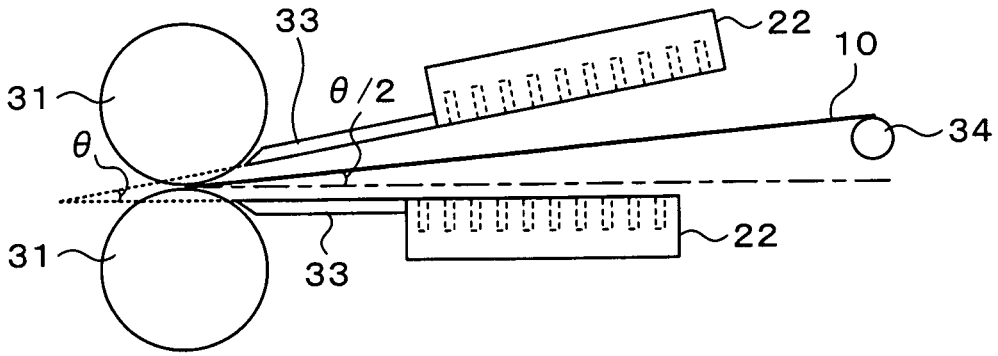
FIG. 9 An explanatory view illustrating a case when a sheet-passing angle (a steel sheet design position) of a hot-rolled steel sheet just after a finish-rolling stand is 1/2 of an angle θ formed by upper and lower guides.

Here, in an actual operation, it is often the case that the sheet-passing angle of the hot-rolled steel sheet 10 in the steady state just after the finish-rolling stand becomes from "0" (zero) degree as illustrated in FIG. 8 to ½ angle of the angle θ formed by the upper and lower guides 33 as illustrated in FIG. 9. In this embodiment, a specific angle when a sheet-passing angle position of the hot-rolled steel sheet 10 is from "0" (zero) to θ/2 angle is set as the sheet-passing angle which is previously determined at the design time such that the expression (1) or the expression (2) is satisfied. The steel sheet design position of the hot-rolled steel sheet 10 may be set at "0" (zero) degree as illustrated in FIG. 8, that is, a tangent plane at an upper vertex of the lower side reduction roll (work roll) 31 of the rolling stand. The tangent plane is a plane which is in contact with the reduction roll including a line connecting the upper vertex of the lower side reduction rolls (work rolls) 31 of the adjacent rolling stands, where the adjacent rolling stands are two rolling stands when the cooling device 21 is between the two rolling stands, and the adjacent rolling stands are the rolling stands F6, F7 when the cooling device 21 is on the exit side of the final rolling stand F7. The steel sheet design position just after the finish-rolling stand may be set at a plane located at ½ of the angle θ formed by the upper and lower guides as illustrated in FIG. 9. By designing the cooling device 21 as stated above, the cooling is enabled such that the collision area of the cooling water sprayed from the nozzle 23 on the hot-rolled steel sheet 10 satisfies the expression (1) or the expression (2) when the sheet-passing angle of the hot-rolled steel sheet 10 just after the finish-rolling stand becomes a specified angle from "0" (zero) degree being the rolling direction to the angle θ formed by the upper and lower guides 33 (preferably ½ angle of the angle θ).

In other words, when there is a cooling device where the sheet-passing angle just after the finish-rolling stand whose collision area of the cooling water sprayed from the nozzle 23 on the hot-rolled steel sheet 10 satisfies the expression (1) or the expression (2) exists from "0" (zero) degree being the rolling direction to the angle θ formed by the upper and lower guides 33 (preferably ½ angle of the angle θ), more uniform cooling can be performed as long as the hot-rolled steel sheet 10 is passed through such that the inclination angle of the hot-rolled steel sheet 10 just after the finish-rolling stand becomes "the sheet-passing angle satisfying the expression (1) or the expression (2)" by using the cooling device.

The cooling device of the present invention can be regarded as a cooling device where the sheet-passing angle just after the finish-rolling stand whose collision area of the cooling water sprayed from the nozzle 23 on the hot-rolled steel sheet 10 satisfies the expression (1) or the expression (2) exists from "0" (zero) degree being the rolling direction to the angle θ formed by the upper and lower guides 33 when the hot-rolled steel sheet 10 is assumed to pass through at a certain sheet-passing angle just after the finish-rolling stand. In other words, (the sheet-passing angle of) the steel sheet design position just after the finish-rolling stand can be regarded as an arbitrary angle within the angles where the collision area of the cooling water sprayed from the nozzle 23 on the hot-rolled steel sheet 10 satisfies the expression (1) or the expression (2) (where the angle exists from "0" (zero) degree being the rolling direction to the angle θ formed by the upper and lower guides 33).

In this embodiment, a water volume density Wa of the cooling water from the nozzle 23 preferably satisfies the following expression (3). The expression (3) represents required cooling capacity to decrease the temperature of the hot-rolled steel sheet 10 to a certain degree. That is, at a left side of the expression (3), ($Wa^{0.5}\times Ma$) being a numerator is (a cooling capacity index per unit time and unit area corresponding to a heat flux)×(cooling-span length), and represents full cooling capacity. Besides, (t×V) being a denominator is a volume of a hot-rolled steel sheet (material) which passes through per unit time in unit width, and corresponds to a required heat quantity to decrease the hot-rolled steel sheet by 1° C. As a result of hard study of inventors, it was found that crystal grains can be properly controlled when the left side of the expression (3) is a certain value being 0.08 or more. The cooling-span length Ma is, for example, 1 m or more and 3 m or less. In such a case, the cooling by 40° C. or more from the $Ar_3$ transformation temperature to the $Ar_3$ transformation temperature −30° C. can be performed just after the rolling, resulting in that coarsening of the crystal grains can be sufficiently prevented to enable refining of the crystal grains.

$$Wa^{0.5}\times Ma/(t\times V)\geq 0.08 \quad (3)$$

Where,

Wa: water volume density of cooling water from nozzle 23 ($m^3/m^2 \cdot min$)

Ma: cooling-span length (m)

t: sheet thickness of hot-rolled steel sheet 10 (mm)

V: sheet-passing speed of hot-rolled steel sheet 10 (m/s)

Regarding the expression (3), Japanese Laid-open Patent Publication No. 2009-241115 discloses that the water volume density W (little/$m^2 \cdot min$) of cooling water satisfies $W^{0.663} \times M \geq 260$, and the cooling-span length M satisfies 1.8 m or less. However, a condition of the water volume density of the cooling water disclosed in Japanese Laid-open Patent Publication No. 2009-241115 does not have conditions of the sheet thickness of the hot-rolled steel sheet and the sheet-passing speed of the hot-rolled steel sheet, and is insufficient.

The angle θ formed by the upper and lower guides 33 falls within a range of, for example, 8 degrees or more and 30 degrees or less. The angle θ may be set to fall within a range of, for example, 8 degrees or more and 25 degrees or less or 10 degrees or more and 30 degrees or less.

In the present invention, the sheet-passing angle of the hot-rolled steel sheet 10 just after the finish-rolling stand which is previously determined at the design time of the cooling device may exceed ½ angle of the angle θ formed by the upper and lower guides 33 as long as it is the angle θ or less formed by the upper and lower guides 33, though the case is excluded in this embodiment.

In the expression (1) or the expression (2), i and j are set to be an arbitrary column (i column, j column) of the nozzle 23 provided in the rolling direction. This means that $(L \cdot \tan \alpha)^2$ is calculated with respect to all of the nozzle columns, and a ratio between a maximum value and a minimum value (the maximum value is the denominator) is 0.90 or more in the expression (1) or the expression (2). Further, when the nozzle spray angle α is constant in the expression (1), a ratio between a maximum value and a minimum value of the nozzle spray distance L (the maximum value is the denominator) is a square root of 0.90 (0.95 when rounded to two digits after the decimal point) or more for all of the nozzle columns in order to set the difference of the collision areas of the nozzle jet flows at arbitrary positions in the rolling direction to be 10% or less. That is, the difference between the maximum value and the minimum value of the nozzle spray distance L is necessary to fall within 5% of the maximum value in order to satisfy the expression (1). Similarly, when the nozzle major axis direction spray angle β is constant and the nozzle minor axis direction spray angle γ is constant, the difference between the maximum value and the minimum value of the nozzle spray distance L is necessary to fall within 5% or less of the maximum value also in the expression (2).

The nozzles used in the cooling device 21 are preferably the same kind of nozzles (for example, full cone nozzles, thickening flat spray nozzles).

According to the above-stated cooling device 21, the hot-rolled steel sheet 10 which passes through the rolling stands to be hot-rolled is cooled by cooling water sprayed from the cooling box 22 just after leaving the reduction rolls 31 under a state where strains remain. This cooling is strong cooling by, for example, 30° C. or more between stands at one location, resulting in that, for example, the time required to reach the $Ar_3$ transformation point is shortened, enlarging of the crystal grain size is suppressed to enable grain refining, to thereby improve quality of the material of the hot-rolled steel sheet 10.

When the sheet-passing speed of the hot-rolled steel sheet 10 is slow, the cooling water is sprayed from the nozzle 23 which is closer to the rolling stand among the nozzles 23 in the cooling box 22. This control is performed by the three-way valve according to the sheet-passing speed set in advance such that the cooling water is supplied to the section 22*a* of the nozzle 23 which sprays the cooling water while giving preference to the nozzle 23 closer to the rolling stand, and other three-way valves 25 provided at the sections 22*a* of the nozzles 23 which are far from the rolling stand are opened toward the drain header 28 or the drain area. When the sheet-passing speed increases and the cooling capacity is to be improved, the three-way valves 25 which are opened toward the drain header 28 are opened toward the cooling box 22 sequentially from the closer side to the farther side from the rolling stand, to increase the sections 22*a* which spray the cooling water to the hot-rolled steel sheet 10. Since an inflow port of the nozzle 23 in the cooling box 22 enters the cooling box 22 even in the section 22*a* of the nozzle 23 which does not spray the cooling water until that time, water retains up to slightly lower than the upper end of the nozzle 23, and water is constantly filled in the pipe 24, the cooling water can be promptly sprayed from the nozzle 23 when the three-way valve 25 is switched. When the sheet-passing speed decreases, the three-way valve 25 is sequentially switched to the drain side from the section 22*a* which is on the farther side from the rolling stand.

As mentioned above, the cooling box 22 is provided at each of the upper and lower guides 33 provided on the exit side of the rolling stand, the spray surface of the nozzles 23 in the cooling box 22 is set to be approximately the same plane with the guide 33, resulting in that the hot-rolled steel sheet 10 just after the rolling can be cooled from a position close thereto and the hot-rolled steel sheet 10 is not up against the nozzles 23. The cooling can be started from a position close to the rolling stand by providing the cooling box 22 at the guide 33 compared to a conventional cooling device where the cooling box is separately provided keeping away from the position of the guide 33. Accordingly, a length size of the cooling box 22 in the rolling direction can be largely secured and the cooling capacity can be increased even between stands where space is limited.

When the reduction roll 31 of the rolling stand is replaced, the guide 33 is necessary to be retreated on the downstream side in the rolling direction, and when the cooling box 22 and the guide 33 are separated, the cooling box 22 has to be additionally moved so as not to collide with the retreated guide 33. According to the present invention, the retreating work at the replace time of the reduction roll 31 can be performed without taking time as same as the case when the cooling box 22 is not provided since the cooling box 22 is provided at the guide 33.

Figure 10:
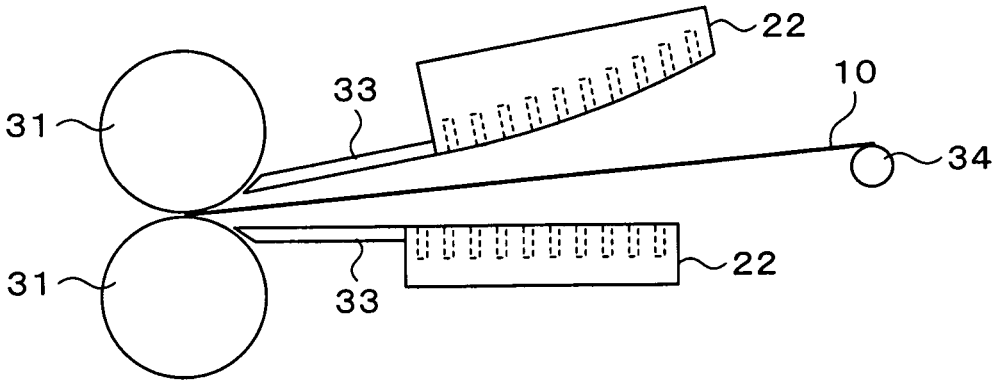
FIG. 10 A side view illustrating a schematic configuration of a finish-rolling stand on an exit side provided with a cooling device according to another embodiment.

The sheet-passing speed during the hot-rolling generally fluctuates depending on desired productivity or the like. When the change of the sheet-passing speed is large, the steel-sheet temperature is necessary to be kept constant to uniformize the quality in a longitudinal direction by changing the cooling capacity according to the sheet-passing speed. At this time, it is thought that a substantial control range of a cooling water volume becomes narrow by regulation using only by the flow rate regulating valve 26 in consideration that spray of water at a low pressure results in nonuniform cooling capacity because a jet shape deteriorates. If the inside of the cooling box 22 is divided like this embodiment, it becomes possible to expand the controllable range by performing the water volume control by the divided section 22*a* in addition to the control range of the flow rate regulating valve 26. In a case of an on/off valve, a response speed delays because the cooling water is let flow from a state where the supply of the cooling water is stopped, but a rapid switching becomes possible even in a large water volume only by switching a spray direction by providing the three-way valve 25 like this embodiment. The large water volume means, for example, 2 to 10 $m^3/m^2/min$ In the aforementioned embodiment, the spray surface of the plurality of nozzles 23 are provided to be approximately the same plane as the guide 33 in the cooling box 22, but the spray surface may not be on the same plane as the guide 33. The spray surface of the nozzles 23 may curve from the upstream side toward the downstream side in the rolling direction as illustrated in FIG. 10. The similar effect as this embodiment can be obtained also in such a case, and the cooling capacity is made uniform to uniformly cool the hot-rolled steel sheet by making the spray angles of the nozzles 23 small from the upstream side toward the downstream side in the rolling direction. As the embodiment illustrated in FIG. 10, the spray surface of the plurality of nozzles 23 on the upper side may be the same plane as the guide 33 or on the upside of the plane. Also in such a case, the spray surface of the plurality of nozzles 23 on the lower side may be the same plane as the guide 33.

Figure 11:
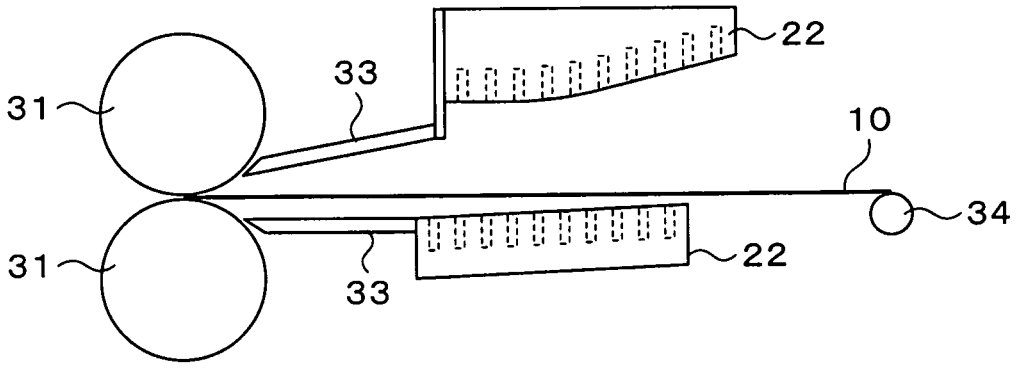
FIG. 11 A side view illustrating a schematic configuration of a finish-rolling stand on an exit side provided with a cooling device according to still another embodiment.

As illustrated in FIG. 11, the plurality of nozzles 23 in the upper side cooling box 22 may be provided such that the spray surface is on the upside of the guide 33. Also in the lower side cooling box 22, the plurality of nozzles 23 may be provided such that the spray surface is on the downside of the guide 33 though it is not illustrated. The spray surface of the plurality of nozzles 23 may be disposed on an opposite side of the steel sheet design position of the hot-rolled steel sheet 10 from the surface formed by the guides 33.

In the aforementioned embodiment, the nozzle spray distances from the plurality of nozzles 23 become large as the nozzle is far from the rolling stand, but the nozzle spray distance may become small in the lower side cooling box 22 as illustrated in FIG. 11. That is, a position where the nozzle spray distance is the largest may be on the most upstream side of the cooling device 21. The nozzle spray distance may become small also in the upper side cooling box 22 though it is not illustrated. The collision area of the cooling water on the hot-rolled steel sheet 10 can be made uniform in the rolling direction and the effect similar to the embodiment can be obtained as long as the following two conditions are simultaneously satisfied: where (1) the spray angle of the nozzle 23 at the position whose nozzle spray distance L is the largest is smaller than the spray angle of the nozzle 23 at the position whose nozzle spray distance L is the smallest, and (2) the spray angle of the nozzle 23 on the side whose nozzle spray distance L is smaller is not smaller than the spray angle of the nozzle 23 on the side whose nozzle spray distance L is larger with respect to the adjoining nozzle 23 in the rolling direction, in both cases when the nozzle spray distance becomes larger and the nozzle spray distance becomes smaller as the nozzle is farther from the rolling stand.

Figure 12:
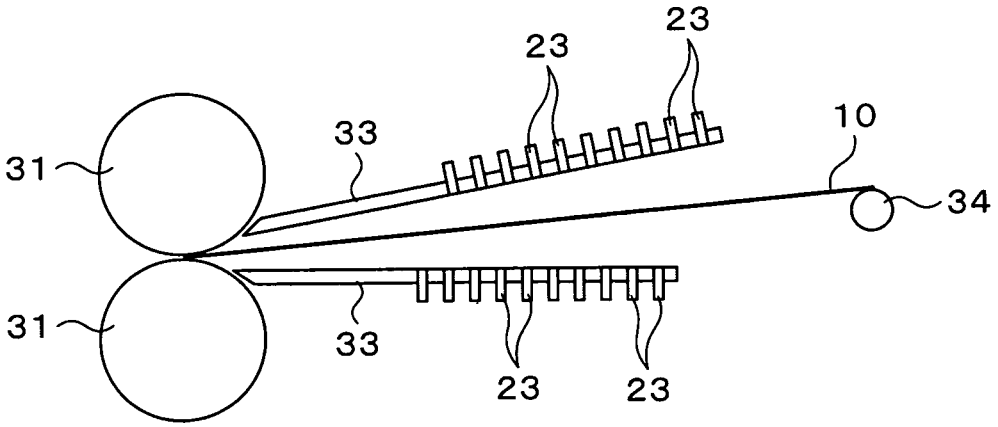
FIG. 12 A side view illustrating a schematic configuration of a finish-rolling stand on an exit side provided with a cooling device according to yet another embodiment.
Figure 13:
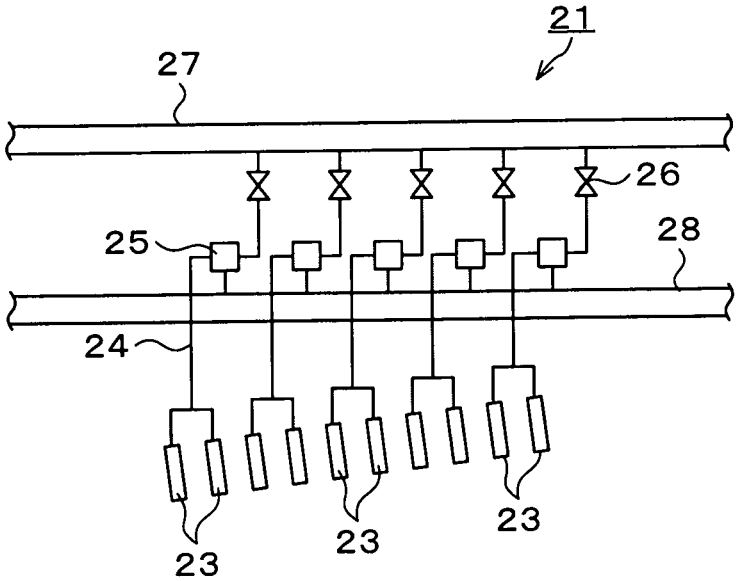
FIG. 13 A view illustrating a schematic configuration of a cooling device according to a further embodiment.

In the aforementioned embodiment, the plurality of nozzles 23 are provided in the cooling box 22, but the cooling box 22 may not be provided as illustrated in FIG. 12 and the plurality of nozzles 23 may be provided at the guide 33. In this case, one nozzle group may be formed by every predetermined number of nozzles 23, where two nozzles 23 in the example in the drawing as illustrated in FIG. 13. Each nozzle group is connected to the pipe 24 where the three-way valve 25 and the flow rate regulating valve 26 are provided similar to the aforementioned embodiment, and the pipe 24 is further connected to the feedwater header 27 and the drain header 28. The effect similar to the aforementioned embodiment can also be obtained in such a case.

Figure 14:
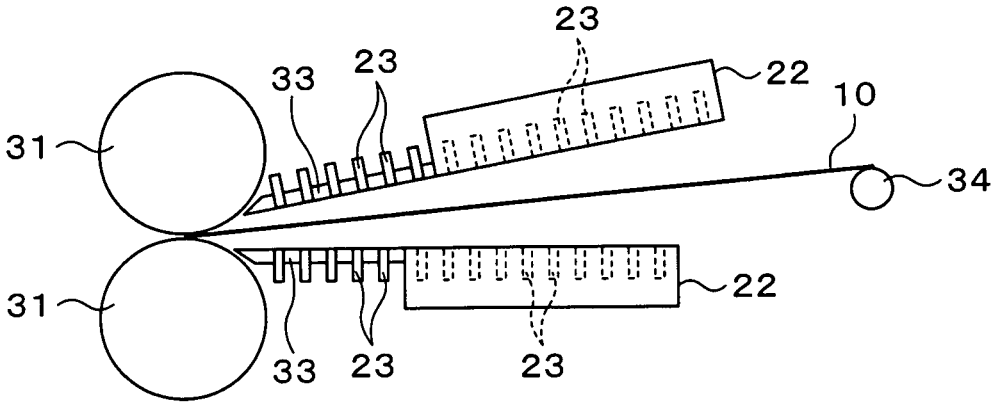
FIG. 14 A side view illustrating a schematic configuration of a finish-rolling stand on an exit side provided with a cooling device according to a still further embodiment.

The plurality of nozzles 23 may be provided either one of an inside of the guide 33 as illustrated in FIG. 12 or a position adjoining to the guide 33 on the downstream side as illustrated in FIGS. 8 to 11. Meanwhile, the plurality of nozzles 23 may be provided at both the inside of the guide 33 and the position adjoining to the guide 33 on the downstream side as illustrated in FIG. 14. In this case, when there are nozzles 23 spraying the cooling water toward both of the upper and lower surfaces of the hot-rolled steel sheet 10, only the plurality of nozzles 23 spraying the cooling water toward one surface may be provided at both the inside of the guide 33 and the position adjoining to the guide 33 on the downstream side. The plurality of nozzles 23 spraying the cooling water toward both of the upper and lower surfaces of the hot-rolled steel sheet 10 may be provided at both the inside of the guide 33 and the position adjoining to the guide 33 on the downstream side. The present invention includes these embodiments where the nozzles are provided at both the inside of the guide 33 and the position adjoining to the guide 33 on the downstream side.

In the aforementioned embodiment, an example is illustrated where the cooling devices 21 are provided at two locations of between the rolling stands F5 and F6, and between the rolling stands F6 and F7, but the cooling device 21 may be provided only at one location of between the rolling stands F6 and F7 depending on desired properties of the hot-rolled steel sheet 10. Otherwise, the cooling device 21 may be provided only at one location on the exit side of the final rolling stand F7. In this case, a water spray device is preferably provided on the downstream side of the cooling device 21 so as to prevent a measurement device (corresponding to a measurement device 50 in FIG. 15) measuring a size and a temperature of the hot-rolled steel sheet 10 provided on the downstream side of the finishing mill 14 from being affected by water.

In the aforementioned embodiment, when the cooling device 21 is disposed between the rolling stands, the reduction rolls 31 of the rolling stand on the downstream side than the cooling device 21 may be opened. For example, when the cooling device 21 is disposed between the rolling stands F6 and F7, the reduction rolls 31 of the rolling stand F7 are opened. In such a case, since there is no soft-reduction after the rapid-cooling just after the rolling, mechanical properties of the hot-rolled steel sheet 10 can be improved by the rapid-cooling just after the finish-rolling without being adversely affected by the soft-reduction.

When the reduction rolls 31 are opened as stated above, a roll gap of the reduction rolls 31 is preferably set to a value where 7 mm is added to an aimed sheet thickness or less. In such a case, an amount of water on the sheet leaking out of the rolling stand can be limited. Further, a water spray device (not illustrated) is preferably provided on the exit side of the most downstream side (final) rolling stand F7. Normally, the measurement device to measure the size, the temperature, and so on of the hot-rolled steel sheet 10 is provided on the exit side of the rolling stand F7 on the most downstream side (final). In such a case, if the water spray device is provided on the exit side of the rolling stand F7, the measurement device on the downstream side of the finishing mill 14 is not adversely affected even though the reduction by the rolling stand F7 is not performed. When the cooling device 21 of the present invention exists on the downstream side of the final rolling stand F7, the position of the measurement device is the downstream side of the cooling device 21 of the present invention.

Figure 15:
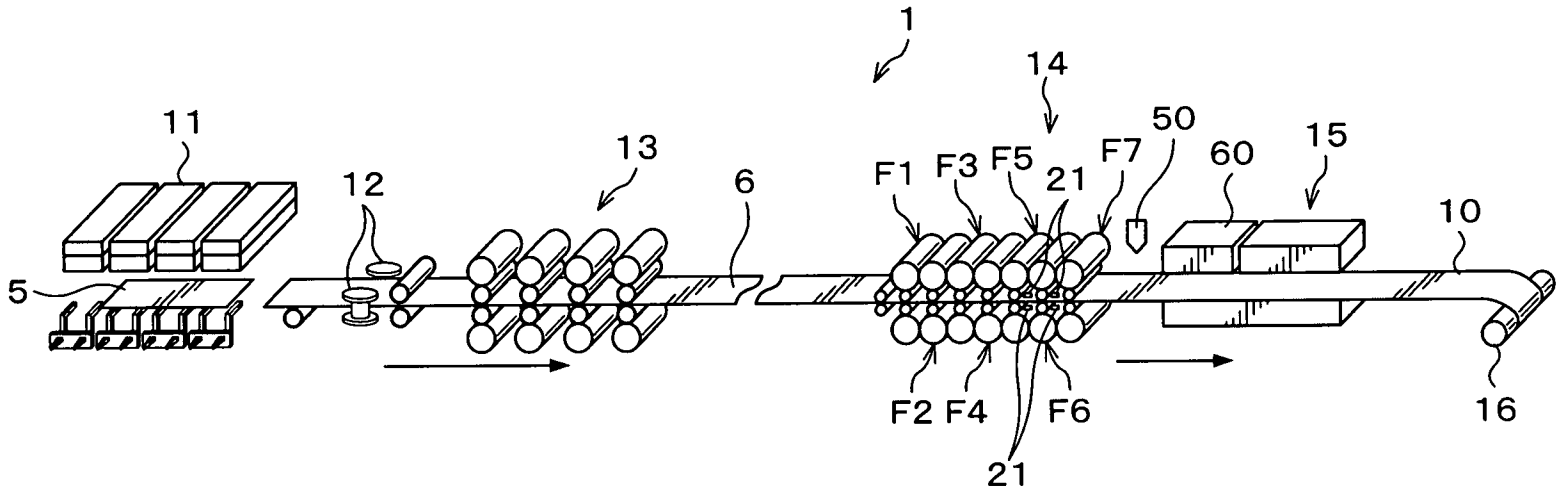
FIG. 15 A view illustrating a schematic configuration of hot-rolling equipment equipped with a cooling device according to a yet further embodiment.

In the aforementioned embodiment, a cooling zone 60 which cools the upper surface of the hot-rolled steel sheet 10 may be provided on the exit side of the final rolling stand F7 of the finishing mill 14, on the downstream side of the measurement device 50 which measures the size, the temperature, and so on of the hot-rolled steel sheet 10 as illustrated in FIG. 15. The cooling zone 60 is provided on, for example, the upstream side of the cooling part 15. For example, a plurality of cooling nozzles (not illustrated) which spray cooling water toward the upper surface of the hot-rolled steel sheet 10 are arranged and disposed in the rolling direction at the cooling zone 60. For example, slit-laminar nozzles, pipe laminar nozzles, or spray nozzles are used as these cooling nozzles.

A water volume density of cooling water from the cooling nozzle of the cooling zone 60 is preferably 2 $m^3/m^2$·min or more, and satisfies the following expression (4). When the water volume density is less than 2 $m^3/m^2$·min, refining of the crystal grain becomes difficult. The expression (4) represents necessary cooling capacity to decrease the temperature of the hot-rolled steel sheet 10 to a certain degree as same as the expression (3). That is, at a left side of the expression (4), ($Wb^{0.5}$×Mb) being a numerator is (a cooling capacity index per unit time and unit area corresponding to a heat flux)×(cooling-span length), and represents a full cooling capacity. Besides, (t×V) being a denominator is a volume of a hot-rolled steel sheet (material) which passes per unit time in unit width, and corresponds to a required heat quantity to decrease the hot-rolled steel sheet by 1° C. As a result of hard study of inventors, it was found that crystal grains can be properly controlled when the left side of the expression (4) is a certain value being 0.55 or more. In such a case, for example, coarsening of the crystal grains can be prevented by cooling the hot-rolled steel sheet 10 just after rolling with the cooling device 21 provided on the exit side of the rolling stand F7, and refining of the crystal grains is enabled and strength adjustment can be performed by further cooling the hot-rolled steel sheet 10 with the cooling zone 60.

$$Wb^{0.5}\times Mb/(t\times V)\geq 0.55 \quad (4)$$

Where,

Wb: water volume density of cooling water from cooling nozzle ($m^3/m^2$·min)

Mb: cooling-span length of cooling zone 60 (m)

t: sheet thickness of hot-rolled steel sheet 10 (mm)

V: sheet-passing speed of hot-rolled steel sheet 10 (m/s)

In the illustrated example, the cooling zone 60 is provided on the upper surface side of the hot-rolled steel sheet 10, but it may be provided on the lower surface side, or on both sides of the upper surface side and the lower surface side. In case that the measurement device 50 is not provided, the cooling zone 60 may be disposed on the downstream side of the cooling device 21 of the present invention.

A preferred embodiment of the present invention has been described above with reference to the accompanying drawings, but the present invention is not limited to the examples. It should be understood that various changes and modifications are readily apparent to those skilled in the art within the scope of the spirit as set forth in claims, and those should also be covered by the technical scope of the present invention.

For example, in the aforementioned embodiment, the plurality of nozzles 23 accompanied by the cooling box 22 or without the cooling box 22 are provided at the inside of both the upper and lower guides 33 and/or adjoining to the guides 33 on the downstream sides, but they may be provided at the inside of either one of the upper or lower guide 33 and/or adjoining to the guide 33 on the downstream side. In the aforementioned embodiment, the plurality of nozzles 23 accompanied by the upper and lower both sides of the cooling boxes 22 or without the cooling box 22 satisfy the expression (1) or the expression (2), but the plurality of nozzles 23 accompanied by either one of the upper or lower cooling box 22 or without the cooling box 22 may satisfy the expression (1) or the expression (2).

In the aforementioned embodiment, the distance between the upper and lower guides 33 becomes larger from the upstream side toward the downstream side in the rolling direction, but a guide may further be provided in the rolling direction (horizontal direction) on the downstream side of the guide 33. A cooling device which cools the hot-rolled steel sheet 10 may be provided at the guide in the horizontal direction. Another cooling device without a guide may further be provided on the downstream side of the cooling device 21 of the present invention.

Example 1

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F6 in FIG. 1. A cooling length was set to 1.2 m, and the number of nozzle columns was set to 5 columns. A water volume density of cooling water from the nozzle on an upper surface side was set to 7 $m^3/m^2$·min, and a water volume density of cooling water from the nozzle on a lower surface side was set to 10 $m^3/m^2$·min. An inclining angle of an upper guide was set to 12 degrees, an inclining angle of a lower guide was set to "0" (zero) degree, that is, an angle θ formed by the upper and lower guides was set to 12 degrees, and a sheet-passing angle of the hot-rolled steel sheet 10 just after the rolling stand F6 made by the looper 34 was set to 6 degrees being θ/2 angle (refer to FIG. 9). A kind of the nozzle was the full cone nozzle. A position and a spread angle of a nozzle jet flow (a nozzle spray angle) of each nozzle are listed in Table 1. In Table 1, a spread angle whose difference from a reference collision area is +10% (a spread angle +10% in Table) and a spread angle whose difference from the reference collision area is −10% (a spread angle −10% in Table) are listed together so as to evaluate the index (the difference between the maximum collision area and the minimum collision area of the nozzle jet flow is set to 10% or less) of the above-stated (1).

As listed in Table 2, temperature variation of the hot-rolled steel sheet in a width direction was checked by varying the spread angle of the nozzle jet flow on the upper surface side (an upper surface spread angle in Table) and the spread angle of the nozzle jet flow on the lower surface side (a lower surface spread angle in Table). In Table 2, a maximum temperature drop in the width direction due to cooling is also listed.

In Examples 1 to 3, the spread angles of the nozzle jet flows on the upper surface side and the lower surface side become smaller from the upstream side toward the downstream side in the rolling direction. In Examples 2, 3, the nozzles on both the upper surface side and the lower surface side satisfy the expression (1). In such a case, the temperature variations in the width direction could be made small to be 20° C. or less, that was 18° C., 11° C., and 13° C. The hot-rolled steel sheet excellent in mechanical properties can be manufactured by uniformly cooling the hot-rolled steel sheet. Underlined parts of Example 1 in Table 2 do not satisfy the expression (1), and an effect of the uniform cooling was small compared to Examples 2 to 3.

Meanwhile, as illustrated in Comparative Examples 1 to 3, the temperature variations in the width direction became large to be 25° C., 27° C., and 26° C. when the spread angles of the nozzle jet flows on the upstream side and the downstream side were made to be the same in the rolling direction. Accordingly, deviation in the mechanical properties of the hot-rolled steel sheets occurred in Comparative Examples 1 to 3.

TABLE 1

<FULL CONE NOZZLE, SHEET-PASSING ANGLE = 6 DEGREES>

| | | DISTANCE FROM 1ST COLUMN (mm) | | | | |
|---|---|---|---|---|---|---|
| | | 0 | 300 | 600 | 900 | 1200 |
| UPPER SURFACE | NOZZLE SPRAY DISTANCE (mm) | 116 | 148 | 181 | 213 | 245 |
| | SPREAD ANGLE (DEGREE) | 62 | 51 | 42 | 36 | 32 |
| | SPREAD ANGLE (DEGREE) + 10% | 64.6 | 52.7 | 44.3 | 38.1 | 33.4 |
| | SPREAD ANGLE (DEGREE) − 10% | 59.6 | 48.2 | 40.4 | 34.7 | 30.3 |
| LOWER SURFACE | NOZZLE SPRAY DISTANCE (mm) | 184 | 215 | 247 | 278 | 310 |
| | SPREAD ANGLE (DEGREE) | 42 | 36 | 32 | 28 | 25 |
| | SPREAD ANGLE (DEGREE) + 10% | 43.6 | 37.7 | 33.2 | 29.6 | 26.7 |
| | SPREAD ANGLE (DEGREE) − 10% | 39.8 | 34.3 | 30.1 | 26.9 | 24.2 |

TABLE 2

<FULL CONE NOZZLE, SHEET-PASSING ANGLE = 6 DEGREES>

| | | DISTANCE FROM 1ST COLUMN (mm) | | | | | TEMPERATURE VARIATION IN WIDTH DIRECTION (° C.) | MAXIMUM TEMPERATURE DROP IN WIDTH DIRECTION (° C.) |
|---|---|---|---|---|---|---|---|---|
| | | 0 | 300 | 600 | 900 | 1200 | | |
| EXAMPLE 1 | UPPER SURFACE SPREAD ANGLE (DEGREE) | 60 | 50 | 40 | 40 | 30 | 18 | 53 |
| | LOWER SURFACE SPREAD ANGLE (DEGREE) | 40 | 35 | 30 | 30 | 25 | | |
| EXAMPLE 2 | UPPER SURFACE SPREAD ANGLE (DEGREE) | 64 | 52 | 44 | 38 | 33 | 11 | 52 |
| | LOWER SURFACE SPREAD ANGLE (DEGREE) | 43 | 37 | 33 | 29 | 26 | | |
| EXAMPLE 3 | UPPER SURFACE SPREAD ANGLE (DEGREE) | 60 | 49 | 41 | 35 | 31 | 13 | 54 |
| | LOWER SURFACE SPREAD ANGLE (DEGREE) | 40 | 35 | 31 | 27 | 25 | | |
| COMPARATIVE EXAMPLE 1 | UPPER SURFACE SPREAD ANGLE (DEGREE) | 45 | 45 | 45 | 45 | 45 | 25 | 43 |
| | LOWER SURFACE SPREAD ANGLE (DEGREE) | 33 | 33 | 33 | 33 | 33 | | |
| COMPARATIVE EXAMPLE 2 | UPPER SURFACE SPREAD ANGLE (DEGREE) | 64 | 64 | 64 | 64 | 64 | 27 | 48 |
| | LOWER SURFACE SPREAD ANGLE (DEGREE) | 43 | 43 | 43 | 43 | 43 | | |
| COMPARATIVE EXAMPLE 3 | UPPER SURFACE SPREAD ANGLE (DEGREE) | 33 | 33 | 33 | 33 | 33 | 26 | 40 |
| | LOWER SURFACE SPREAD ANGLE (DEGREE) | 26 | 26 | 26 | 26 | 26 | | |

Example 2

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F6 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, an inclining angle of a lower guide was set to "0" (zero) degree, and a sheet-passing angle of the hot-rolled steel sheet 10 just after the rolling stand F6 made by the looper 34 was set to "0" (zero) degree being a rolling direction (refer to FIG. 8). A kind of the nozzle was the full cone nozzle. A position and a spread angle of a nozzle jet flow (a nozzle spray angle) of each nozzle are listed in Table 3. In Table 3, a spread angle whose difference from a reference collision area is +10% (a spread angle +10% in Table) and a spread angle whose difference from the reference collision area is −10% (a spread angle −10% in Table) are listed together so as to evaluate the index (the difference between the maximum collision area and the minimum collision area of the nozzle jet flow is set to 10% or less) of the above-stated (1).

As illustrated in Table 4, temperature variation of the hot-rolled steel sheet in a width direction was checked by varying the spread angle of the nozzle jet flow on the upper surface side (an upper surface spread angle in Table) and the spread angle of the nozzle jet flow on the lower surface side (a lower surface spread angle in Table). In Table 4, a maximum temperature drop in the width direction due to cooling is also listed.

In Example 4, the spread angles of the nozzle jet flow on the upper surface side becomes the same or smaller from the upstream side toward the downstream side in the rolling direction. In Example 5, the nozzle on the upper surface side further satisfies the expression (1). In such a case, the temperature variations in the width direction could be made small to be 20° C. or less, that was 18° C. and 11° C. The hot-rolled steel sheet excellent in mechanical properties can be manufactured by uniformly cooling the hot-rolled steel sheet. Underlined parts of Example 4 in Table 4 do not satisfy the expression (1), and an effect of the uniform cooling was small compared to Example 5.

Meanwhile, as illustrated in Comparative Examples 4, 5, the temperature variations in the width direction became large to be 27° C. and 29° C. when the spread angles of the nozzle jet flows on the upstream side and the downstream side were made to be the same in the rolling direction. Accordingly, deviation in the mechanical properties of the hot-rolled steel sheets occurred in Comparative Examples 4, 5.

TABLE 3

<FULL CONE NOZZLE, SHEET-PASSING ANGLE = 0 DEGREE>

| | | DISTANCE FROM 1ST COLUMN (mm) | | | | |
|---|---|---|---|---|---|---|
| | | 0 | 300 | 600 | 900 | 1200 |
| UPPER SURFACE | NOZZLE SPRAY DISTANCE (mm) | 235 | 300 | 365 | 430 | 495 |
| | SPREAD ANGLE (DEGREE) | 33 | 26 | 22 | 18 | 16 |
| | SPREAD ANGLE (DEGREE) + 10% | 34.7 | 27.5 | 22.7 | 19.4 | 16.9 |
| | SPREAD ANGLE (DEGREE) − 10% | 31.6 | 25.0 | 20.6 | 17.5 | 15.3 |
| LOWER SURFACE | NOZZLE SPRAY DISTANCE (mm) | 70 | 70 | 70 | 70 | 70 |
| | SPREAD ANGLE (DEGREE) | 90 | 90 | 90 | 90 | 90 |
| | SPREAD ANGLE (DEGREE) + 10% | 92.7 | 92.7 | 92.7 | 92.7 | 92.7 |
| | SPREAD ANGLE (DEGREE) − 10% | 87.0 | 87.0 | 87.0 | 87.0 | 87.0 |

TABLE 4

<FULL CONE NOZZLE, SHEET-PASSING ANGLE = 0 DEGREE>

| | | DISTANCE FROM 1ST COLUMN (mm) | | | | | TEMPERATURE VARIATION IN WIDTH DIRECTION (° C.) | MAXIMUM TEMPERATURE DROP IN WIDTH DIRECTION (° C.) |
|---|---|---|---|---|---|---|---|---|
| | | 0 | 300 | 600 | 900 | 1200 | | |
| EXAMPLE 4 | UPPER SURFACE SPREAD ANGLE (DEGREE) | 32 | 27 | 18 | 18 | 18 | 18 | 51 |
| | LOWER SURFACE SPREAD ANGLE (DEGREE) | 90 | 90 | 90 | 90 | 90 | | |
| EXAMPLE 5 | UPPER SURFACE SPREAD ANGLE (DEGREE) | 34 | 27 | 22 | 19 | 16 | 11 | 53 |
| | LOWER SURFACE SPREAD ANGLE (DEGREE) | 90 | 90 | 90 | 90 | 90 | | |
| COMPARATIVE EXAMPLE 4 | UPPER SURFACE SPREAD ANGLE (DEGREE) | 40 | 40 | 40 | 40 | 40 | 27 | 46 |
| | LOWER SURFACE SPREAD ANGLE (DEGREE) | 90 | 90 | 90 | 90 | 90 | | |

TABLE 4-continued

| <FULL CONE NOZZLE, SHEET-PASSING ANGLE = 0 DEGREE> | | | | | | | | |
|---|---|---|---|---|---|---|---|---|
| | | DISTANCE FROM 1ST COLUMN (mm) | | | | | TEMPERATURE VARIATION IN WIDTH | MAXIMUM TEMPERATURE DROP IN |
| | | 0 | 300 | 600 | 900 | 1200 | DIRECTION (° C.) | WIDTH DIRECTION (° C.) |
| COMPARATIVE EXAMPLE 5 | UPPER SURFACE SPREAD ANGLE (DEGREE) | 20 | 20 | 20 | 20 | 20 | 29 | 38 |
| | LOWER SURFACE SPREAD ANGLE (DEGREE) | 80 | 80 | 80 | 80 | 80 | | |

Example 3

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F6 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, an inclining angle of a lower guide was set to "0" (zero) degree, that is, the angle θ formed by the upper and lower guides was set to 12 degrees, and a sheet-passing angle of the hot-rolled steel sheet 10 just after the rolling stand F6 made by the looper 34 was set to 6 degrees being θ/2 angle (refer to FIG. 9). A kind of the nozzle was the thickening flat spray nozzle. A position and spread angles of a nozzle jet flow in a major axis and a minor axis (nozzle spray angles) of each nozzle are listed in Table 5. In Table 5, a spread angle whose difference from a reference collision area is +10% (a spread angle +10% in Table) and a spread angle whose difference from the reference collision area is −10% (a spread angle −10% in Table) are listed together so as to evaluate the index (the difference between the maximum collision area and the minimum collision area of the nozzle jet flow is set to 10% or less) of the above-stated (2).

As illustrated in Table 6, temperature variation of the hot-rolled steel sheet in a width direction was checked by varying the spread angle of the nozzle jet flow on the upper surface side (a major axis spread angle and a minor axis spread angle in Table) and the spread angle of the nozzle jet flow on the lower surface side (a major axis spread angle and a minor axis spread angle in Table). In Table 6, a maximum temperature drop in the width direction due to cooling is also listed.

In Example 6, the major axis spread angle and the minor axis spread angle of the nozzle jet flow on the upper surface side and the major axis spread angle and the minor axis spread angle of the nozzle jet flow on the lower surface side became the same or smaller from the upstream side toward the downstream side in the rolling direction. In such a case, the temperature variation in the width direction could be made small to be 17° C. The hot-rolled steel sheet excellent in mechanical properties can be manufactured by uniformly cooling the hot-rolled steel sheet as stated above. Underlined parts of Example 6 in Table 6 do not satisfy the expression (2).

In Example 7, the major axis spread angle and the minor axis spread angle of the nozzle jet flow on the upper surface side and the major axis spread angle and the minor axis spread angle of the nozzle jet flow on the lower surface side on the most upstream side (0 mm) are respectively smaller compared to those on the most downstream side (1200 mm) The major axis spread angle and the minor axis spread angle of the nozzle jet flow on the upper surface side and the major axis spread angle and the minor axis spread angle of the nozzle jet flow on the lower surface side became respectively smaller from the upstream side toward the downstream side in the rolling direction, and both the upper surface side and the lower surface side satisfy the expression (2). In such a case, the temperature variation in the width direction could be made sufficiently small to be 12° C.

TABLE 5

| <THICKENING FLAT SPRAY NOZZLE, SHEET-PASSING ANGLE = 6 DEGREES> | | | | | | | |
|---|---|---|---|---|---|---|---|
| | | | DISTANCE FROM 1ST COLUMN (mm) | | | | |
| | | | 0 | 300 | 600 | 900 | 1200 |
| UPPER SURFACE | | NOZZLE SPRAY DISTANCE (mm) | 116 | 148 | 181 | 213 | 245 |
| | MAJOR AXIS | SPREAD ANGLE (DEGREE) | 92 | 78 | 67 | 59 | 52 |
| | | SPREAD ANGLE (DEGREE) + 10% | 94.6 | 80.6 | 69.8 | 61.2 | 54.4 |
| | | SPREAD ANGLE (DEGREE) − 10% | 88.9 | 75.0 | 64.5 | 56.3 | 49.8 |
| | MINOR AXIS | SPREAD ANGLE (DEGREE) | 29 | 23 | 19 | 16 | 14 |
| | | SPREAD ANGLE (DEGREE) + 10% | 30.3 | 24.0 | 19.8 | 16.8 | 14.6 |
| | | SPREAD ANGLE (DEGREE) − 10% | 27.6 | 21.7 | 17.9 | 15.2 | 13.3 |
| LOWER SURFACE | | NOZZLE SPRAY DISTANCE (mm) | 184 | 215 | 247 | 278 | 310 |
| | MAJOR AXIS | SPREAD ANGLE (DEGREE) | 66 | 45 | 40 | 36 | 32 |
| | | SPREAD ANGLE (DEGREE) + 10% | 68.9 | 47.4 | 41.9 | 37.5 | 33.9 |
| | | SPREAD ANGLE (DEGREE) − 10% | 63.6 | 43.3 | 38.2 | 34.1 | 30.8 |
| | MINOR AXIS | SPREAD ANGLE (DEGREE) | 19 | 16 | 14 | 12 | 11 |
| | | SPREAD ANGLE (DEGREE) + 10% | 19.5 | 16.6 | 14.5 | 12.9 | 11.6 |
| | | SPREAD ANGLE (DEGREE) − 10% | 17.6 | 15.1 | 13.2 | 11.7 | 10.5 |

TABLE 6

<THICKENING FLAT SPRAY NOZZLE SHEET-PASSING ANGLE = 6 DEGREES>

| | | | DISTANCE FROM 1ST COLUMN (mm) | | | | | TEMPERATURE VARIATION IN WIDTH DIRECTION (° C.) | MAXIMUM TEMPERATURE DROP IN WIDTH DIRECTION (° C.) |
|---|---|---|---|---|---|---|---|---|---|
| | | | 0 | 300 | 600 | 900 | 1200 | | |
| EXAMPLE 6 | UPPER SURFACE | MAJOR AXIS SPREAD ANGLE (DEGREE) | 90 | 80 | 60 | 60 | 50 | 17 | 54 |
| | | MINOR AXIS SPREAD ANGLE (DEGREE) | 30 | 20 | 20 | 20 | 14 | | |
| | LOWER SURFACE | MAJOR AXIS SPREAD ANGLE (DEGREE) | 65 | 45 | 40 | 36 | 32 | | |
| | | MINOR AXIS SPREAD ANGLE (DEGREE) | 18 | 15 | 15 | 15 | 10 | | |
| EXAMPLE 7 | UPPER SURFACE | MAJOR AXIS SPREAD ANGLE (DEGREE) | 90 | 80 | 65 | 60 | 50 | 12 | 53 |
| | | MINOR AXIS SPREAD ANGLE (DEGREE) | 30 | 22 | 19 | 16 | 14 | | |
| | LOWER SURFACE | MAJOR AXIS SPREAD ANGLE (DEGREE) | 65 | 45 | 40 | 36 | 32 | | |
| | | MINOR AXIS SPREAD ANGLE (DEGREE) | 18 | 16 | 14 | 12 | 11 | | |

Example 4

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F6 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, an inclining angle of a lower guide was set to "0" (zero) degree, and a sheet-passing angle of the hot-rolled steel sheet 10 just after the rolling stand F6 made by the looper 34 was set to "0" (zero) degree being a rolling direction (refer to FIG. 8). A kind of the nozzle was the thickening flat spray nozzle. A position and spread angles of a nozzle jet flow in a major axis and a minor axis (nozzle spray angles) of each nozzle are listed in Table 7. In Table 7, a spread angle whose difference from a reference collision area is +10% (a spread angle +10% in Table) and a spread angle whose difference from the reference collision area is −10% (a spread angle −10% in Table) are listed together so as to evaluate the index (the difference between the maximum collision area and the minimum collision area of the nozzle jet flow is set to 10% or less) of the above-stated (2).

As illustrated in Table 8, temperature variation of the hot-rolled steel sheet in a width direction was checked by varying the spread angle of the nozzle jet flow on the upper surface side (a major axis spread angle and a minor axis spread angle in Table) and the spread angle of the nozzle jet flow on the lower surface side (a major axis spread angle and a minor axis spread angle in Table). In Table 8, a maximum temperature drop in the width direction due to cooling is also listed.

In Example 8, the major axis spread angle and the minor axis spread angle of the nozzle jet flow on the upper surface side and the major axis spread angle became respectively smaller from the upstream side toward the downstream side in the rolling direction, and the upper surface side nozzle (the major axis side) satisfies the expression (2). In such a case, the temperature variation in the width direction could be made small to be 16° C. The hot-rolled steel sheet excellent in mechanical properties can be manufactured by uniformly cooling the hot-rolled steel sheet. Underlined parts of Example 8 in Table 8 do not satisfy the expression (2).

In Example 9, the major axis spread angle and the minor axis spread angle of the nozzle jet flow on the upper surface side on the most upstream side (0 mm) are respectively smaller compared to the most downstream side (1200 mm) The major axis spread angle and the minor axis spread angle of the upper surface side nozzle jet flow became respectively the same or smaller from the upstream side toward the downstream side in the rolling direction, further both the upper surface side and the lower surface side satisfy the expression (2). In such a case, the temperature variation in the width direction could be made sufficiently small to be 11° C., and the effect of the uniform cooling was larger compared to Example 8.

TABLE 7

<THICKENING FLAT SPRAY NOZZLE, SHEET-PASSING ANGLE = 0 DEGREE>

| | | | DISTANCE FROM 1ST COLUMN (mm) | | | | |
|---|---|---|---|---|---|---|---|
| | | | 0 | 300 | 600 | 900 | 1200 |
| UPPER SURFACE | | NOZZLE SPRAY DISTANCE (mm) | 235 | 300 | 365 | 430 | 495 |
| | MAJOR AXIS | SPREAD ANGLE (DEGREE) | 54 | 44 | 36 | 31 | 27 |
| | | SPREAD ANGLE (DEGREE) + 10% | 56.4 | 45.5 | 38.0 | 32.6 | 28.5 |
| | | SPREAD ANGLE (DEGREE) − 10% | 51.8 | 41.6 | 34.6 | 29.6 | 25.9 |

TABLE 7-continued

| <THICKENING FLAT SPRAY NOZZLE, SHEET-PASSING ANGLE = 0 DEGREE> | | | DISTANCE FROM 1ST COLUMN (mm) | | | | |
|---|---|---|---|---|---|---|---|
| | | | 0 | 300 | 600 | 900 | 1200 |
| | MINOR AXIS | SPREAD ANGLE (DEGREE) | 15 | 11 | 9 | 8 | 7 |
| | | SPREAD ANGLE (DEGREE) + 10% | 15.3 | 12.0 | 9.9 | 8.4 | 7.3 |
| | | SPREAD ANGLE (DEGREE) − 10% | 13.8 | 10.8 | 8.9 | 7.6 | 6.6 |
| LOWER SURFACE | | NOZZLE SPRAY DISTANCE (mm) | 100 | 100 | 100 | 100 | 100 |
| | MAJOR AXIS | SPREAD ANGLE (DEGREE) | 81 | 81 | 81 | 81 | 81 |
| | | SPREAD ANGLE (DEGREE) + 10% | 83.4 | 83.4 | 83.4 | 83.4 | 83.4 |
| | | SPREAD ANGLE (DEGREE) − 10% | 77.8 | 77.8 | 77.8 | 77.8 | 77.8 |
| | MINOR AXIS | SPREAD ANGLE (DEGREE) | 26 | 26 | 26 | 26 | 26 |
| | | SPREAD ANGLE (DEGREE) + 10% | 27.1 | 27.1 | 27.1 | 27.1 | 27.1 |
| | | SPREAD ANGLE (DEGREE) − 10% | 24.6 | 24.6 | 24.6 | 24.6 | 24.6 |

TABLE 8

| <THICKENING FLAT SPRAY NOZZLE, SHEET-PASSING ANGLE = 0 DEGREE> | | | DISTANCE FROM 1ST COLUMN (mm) | | | | | TEMPERATURE VARIATION IN WIDTH DIRECTION (° C.) | MAXIMUM TEMPERATURE DROP IN WIDTH DIRECTION (° C.) |
|---|---|---|---|---|---|---|---|---|---|
| | | | 0 | 300 | 600 | 900 | 1200 | | |
| EXAMPLE 8 | UPPER SURFACE | MAJOR AXIS SPREAD ANGLE (DEGREE) | 55 | 45 | 35 | 30 | 30 | 16 | 52 |
| | | MINOR AXIS SPREAD ANGLE (DEGREE) | 15 | 10 | 10 | 10 | 10 | | |
| | LOWER SURFACE | MAJOR AXIS SPREAD ANGLE (DEGREE) | 80 | 80 | 80 | 80 | 80 | | |
| | | MINOR AXIS SPREAD ANGLE (DEGREE) | 25 | 25 | 25 | 25 | 25 | | |
| EXAMPLE 9 | UPPER SURFACE | MAJOR AXIS SPREAD ANGLE (DEGREE) | 55 | 45 | 35 | 30 | 27 | 13 | 54 |
| | | MINOR AXIS SPREAD ANGLE (DEGREE) | 15 | 11 | 9 | 8 | 7 | | |
| | LOWER SURFACE | MAJOR AXIS SPREAD ANGLE (DEGREE) | 80 | 80 | 80 | 80 | 80 | | |
| | | MINOR AXIS SPREAD ANGLE (DEGREE) | 25 | 25 | 25 | 25 | 25 | | |

Example 5

The hot-rolled steel sheets with the sheet width of 1200 mm respectively under conditions listed in Table 9 were each subjected to the hot-finish rolling, and the cooling device 21 according to this example was located on the exit side of the rolling stand F6 in FIG. 1. A cooling length and a water volume density of each of upper and lower surfaces were set as listed in Table 9, and the number of nozzle columns was set to 5 columns. An inclining angle of an upper guide was set to 12 degrees, an inclining angle of a lower guide was set to "0" (zero) degree, that is, the angle θ formed by the upper and lower guides was set to 12 degrees, and a sheet-passing angle of the hot-rolled steel sheet 10 just after the rolling stand F6 made by the looper 34 was set to "0" (zero) degree. A kind of the nozzle was the full cone nozzle. A position and a spread angle of a nozzle jet flow (a nozzle spray angle) of each nozzle were as listed in Table 3. The spread angle was set as Example 4 in Table 4. Table 9 lists results thereof. The temperature drop of 40° C. or more could be obtained where the steel sheet could be cooled from the temperature higher than the $Ar_3$ transformation temperature to the $Ar_3$ transformation temperature −30° C. according to the index of the expression (3) (the left side of the expression (3) is 0.08 or more), and as long as the condition satisfied the expression (3) as illustrated in Examples 10 to 18. However, as illustrated in each of Comparative Examples 6 to 9, under a state where the condition of the expression (3) was not satisfied, the temperature drop was 40° C. or less, and the cooling was insufficient to obtain the desired refining effect of the metal structure.

TABLE 9

| | SHEET THICKNESS (mm) | SHEET-PASSING SPEED (mpm) | WATER VOLUME DENSITY ($m^3/m^2 \cdot min$) | COOLING LENGTH (m) | INDEX VALUE (—) | COOLING TEMPERATURE (° C.) |
|---|---|---|---|---|---|---|
| EXAMPLE 10 | 4 | 380 | 7 | 1.0 | 0.104 | 52 |
| EXAMPLE 11 | 4 | 400 | 7 | 1.0 | 0.099 | 47 |
| EXAMPLE 12 | 4 | 420 | 4 | 1.5 | 0.107 | 56 |

TABLE 9-continued

| | SHEET THICKNESS (mm) | SHEET-PASSING SPEED (mpm) | WATER VOLUME DENSITY ($m^3/m^2 \cdot min$) | COOLING LENGTH (m) | INDEX VALUE (—) | COOLING TEMPERATURE (° C.) |
|---|---|---|---|---|---|---|
| EXAMPLE 13 | 5 | 350 | 9 | 0.9 | 0.093 | 46 |
| EXAMPLE 14 | 5 | 320 | 7 | 1.2 | 0.119 | 57 |
| EXAMPLE 15 | 5 | 300 | 5 | 1.1 | 0.098 | 52 |
| EXAMPLE 16 | 6 | 280 | 7 | 1.1 | 0.104 | 52 |
| EXAMPLE 17 | 6 | 380 | 9 | 1.2 | 0.095 | 45 |
| EXAMPLE 18 | 7 | 400 | 10 | 1.2 | 0.081 | 43 |
| COMPARATIVE EXAMPLE 6 | 4 | 420 | 4 | 1.0 | 0.071 | 36 |
| COMPARATIVE EXAMPLE 7 | 5 | 500 | 5 | 1.2 | 0.064 | 31 |
| COMPARATIVE EXAMPLE 8 | 6 | 450 | 7 | 1.2 | 0.071 | 37 |
| COMPARATIVE EXAMPLE 9 | 6 | 420 | 10 | 0.8 | 0.060 | 30 |

Example 6

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F6 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, an inclining angle of a lower guide was set to "0" (zero) degree, and a sheet-passing angle of the hot-rolled steel sheet 10 just after the rolling stand F6 made by the looper 34 was set to "0" (zero) degree being a rolling direction (refer to FIG. 8). A kind of the nozzle was the full cone nozzle. A position and a spread angle of a nozzle jet flow (a nozzle spray angle) of each nozzle are as listed in Table 3.

A spread angle of a nozzle jet flow on an upper surface side (an upper surface spread angle in Table) and a spread angle of a nozzle jet flow on a lower surface side (a lower surface spread angle in Table) were set as illustrated in Example 4 in Table 4. A water spray device was provided on the exit side of the F7 stand, and a gap of the F7 stand was changed from a sheet thickness +3 mm to +15 mm, an amount of outflow water became large when the gap exceeded the sheet thickness +7 mm, and it turned out that a place where the sheet thickness measurement and the sheet temperature measurement could not be performed was generated on a downstream side of the water spray device if the draining amount on the exit side of the F7 stand was not set to 1.5 times or more of a case when the gap was the sheet thickness +7 mm or less.

Example 7

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F7 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, an inclining angle of a lower guide was set to "0" (zero) degree. Since the looper 34 was not provided at a rear side of the rolling stand F7, the sheet-passing angle of the hot-rolled steel sheet 10 just after the rolling stand F7 became "0" (zero) degree being the rolling direction. A kind of the nozzle was the full cone nozzle. A position and a spread angle of a nozzle jet flow (a nozzle spray angle) of each nozzle are as listed in Table 3.

A spread angle of a nozzle jet flow on an upper surface side (an upper surface spread angle in Table) and a spread angle of a nozzle jet flow on a lower surface side (a lower surface spread angle in Table) were set as illustrated in Example 4 in Table 4. A water spray device was provided on an exit side of the F7 stand, and a draining amount on the exit side of the rolling stand F7 was set to be twice or more compared to the case of Example 6 where the cooling device 21 was provided on the exit side of the rolling stand F6 and the reduction rolls of the rolling stand F7 were opened to function as the water spray device, it turned out that there was no effect on the sheet thickness measurement and the sheet temperature measurement on the downstream side of the water spray device.

Example 8

A hot-rolled steel sheet with a sheet thickness of 3 mm and a sheet width of 1200 mm was subjected to hot-finish-rolling at a sheet-passing speed of 400 to 600 mpm, and the cooling device 21 according to this example was located on the exit side of the rolling stand F7 in FIG. 1. A cooling length was set to 1.2 m, and the number of nozzle columns was set to 5 columns. A water volume density of cooling water from the nozzle on an upper surface side was set to 7 $m^3/m^2 \cdot min$, and a water volume density of cooling water from the nozzle on a lower surface side was set to 10 $m^3/m^2 \cdot min$. An inclining angle of an upper guide was set to 12 degrees, and an inclining angle of a lower guide was set to "0" (zero) degree. Since the looper 34 was not provided at a rear side of the rolling stand F7, the sheet-passing angle of the hot-rolled steel sheet 10 just after the rolling stand F7 became "0" (zero) degree being the rolling direction. A kind of the nozzle was the full cone nozzle. A position and a spread angle of a nozzle jet flow (a nozzle spray angle) of each nozzle are as listed in Table 3.

In this Example, the cooling zone 60 illustrated in FIG. 15 was further provided on the upstream side of the cooling part 15 and on the upper surface side of the hot-rolled steel sheet 10. A cooling-span length of the cooling zone 60 (a facility length) was set to 15 m. A water volume density of cooling water from the cooling nozzle of the cooling zone 60 was set to 3 $m^3/m^2 \cdot min$. In this Example, the cooling zone 60 satisfies the expression (4).

When the cooling of the hot-rolled steel sheet 10 by the cooling device 21 and the cooling zone 60 was performed like this Example, the refining of the metal structure of the hot-rolled steel sheet 10 could further be advanced compared to the case of Example 7 where the cooling device 21 was provided and the cooling zone 60 was not provided.

INDUSTRIAL APPLICABILITY

The present invention is applied as a cooling device and a cooling method to enable refining of a crystal grain size of a hot-rolled steel sheet after finish-rolling of a hot-rolling process, and is suitable to enable a quality improvement effect of a high-quality steel such as, for example, high-tensile strength steel (high-ten), ultralow carbon steel (IF steel: interstitial atom free steel), and the like.

EXPLANATION OF CODES

1 hot-rolling equipment
5 slab
6 rough bar
10 hot-rolled steel sheet
11 heating furnace
12 width direction rolling mill
13 roughing mill
14 finishing mill
15 cooling part
16 winding device
21 cooling device
22 cooling box
22*a* section
23 nozzle
23*a* spray port
23*b* end part
24 pipe
25 three-way valve
26 flow rate regulating valve
27 feedwater header
28 drain header
31 reduction roll (work roll)
32 roll cooling water header
33 guide
34 looper
50 measurement device
60 cooling zone
F1, F2, F3, F4, F5, F6, F7 rolling stand (finish-rolling stand)

What is claimed is:

1. A cooling device of a hot-rolled steel sheet, comprising:

a plurality of nozzles which spray cooling water toward at least an upper surface of the hot-rolled steel sheet just after rolled by rolling stands in a hot-finish-rolling mill formed of a plurality of rolling stands, wherein the nozzles are provided on an inside of at least guides on an upper surface side or adjoining to guides on a downstream side between guides provided at upper and lower sides on an exit side of the rolling stand, a steel sheet design position of the hot-rolled steel sheet which is set between upper and lower guides is used as a reference, and a nozzle spray distance along a spray center axis between a spray port of each of the respective plurality of nozzles and the steel sheet design position changes depending on a position of the nozzle in a rolling direction, wherein a spray angle of one of the plurality of nozzles at a position whose nozzle spray distance is the largest is smaller than a spray angle of another one of the plurality of nozzles at a position whose nozzle spray distance is the smallest, and the spray angle of each of the respective plurality of nozzles becomes the same or smaller as the nozzle spray distance becomes large, the plurality of nozzles are arranged in a width direction of the hot-rolled steel sheet to form columns, and a predetermined number of the columns are put together in the rolling direction to form a plurality of nozzle groups arranged in the rolling direction, a maximum number of the plurality of nozzle groups is the same as the number of columns in the rolling direction of the nozzles provided in the rolling direction, a pipe where cooling water is supplied is connected to each of the nozzle groups, a three-way valve and a flow rate regulating valve are provided at each pipe, the three-way valve is provided between a feedwater header which supplies the cooling water to a the respective one of the plurality of nozzles and a drain header which drains the cooling water or a drain area, the flow rate regulating valve is provided between the feedwater header and the three-way valve, the three-way valve is disposed at a height lower than an end part of the respective one of the plurality of nozzles above the upper surface of the hot-rolled steel sheet and on an opposite side of the spray port, the plurality of nozzles are provided on the inside of a cooling box, the inside of the cooling box is divided into a plurality of sections in the rolling direction, the pipe is provided in each of the sections, and a tip of the pipe is disposed at a height lower than the end part of the respective one of the plurality of nozzles above the upper surface of the hot-rolled steel sheet and on the opposite side of the spray port so that the inside of the pipe is constantly filled with the cooling water.

2. The cooling device of the hot-rolled steel sheet according to claim 1, wherein the steel sheet design position is set on a tangent plane at an upper vertex of a lower side reduction roll of the rolling stand.

3. The cooling device of the hot-rolled steel sheet according to claim 1, wherein the steel sheet design position is set on a plane at ½ angle of an angle formed by the upper and lower guides.

4. The cooling device of the hot-rolled steel sheet according to claim 1, wherein the position whose nozzle spray distance is the smallest is located on a most upstream side of the cooling device, and the position whose nozzle spray distance is the largest is located on a most downstream side of the cooling device.

5. The cooling device of the hot-rolled steel sheet according to claim 1, wherein the position whose nozzle spray distance is the largest is located on a most upstream side of the cooling device, and the position whose nozzle spray distance is the smallest is located on a most downstream side of the cooling device.

6. The cooling device of the hot-rolled steel sheet according to claim 1, wherein spray ports of the plurality of nozzles in the cooling box are located on a same plane as an inner surface of the cooling box on the steel sheet design position side or the spray ports are located at a center of the cooling box, and the end part of each of the plurality of nozzles on the opposite side of the spray port protrudes into the cooling box from a position of an inner surface of a wall part where the plurality of nozzles are arranged in the cooling box.

7. The cooling device of the hot-rolled steel sheet according to claim 1, wherein spray ports of the plurality of nozzles are disposed on the same plane as a surface on the steel sheet design position side surface of the guide.

8. The cooling device of the hot-rolled steel sheet according to claim 1, wherein spray ports of the plurality of nozzles are disposed on an opposite side of the steel sheet design position than a surface on the steel sheet design position side surface of the guide.

9. The cooling device of the hot-rolled steel sheet according to claim 1, wherein each of the plurality of nozzles is a full cone nozzle, and a collision region of cooling water sprayed from each of the plurality of nozzles on the hot-rolled steel sheet satisfies the following expression (1),

[Mathematical expression 1]

$$\left|1-\frac{(L_j\cdot\tan\alpha_j)^2}{(L_i\cdot\tan\alpha_i)^2}\right|\leq 0.10 \quad (1)$$

Where,

L: nozzle spray distance (m)

α: nozzle spray angle (degree)

i,j: arbitrary column (i column, j column) of nozzle provided in rolling direction.

10. The coolie; device of the hot-rolled steel sheet according to claim 1, wherein each of the plurality of nozzles is a thickening flat spray nozzle, and a collision area of cooling water sprayed from each of the plurality of nozzles nozzle on the hot-rolled steel sheet satisfies the following expression (2),

[Mathematical expression 2]

$$\left|1-\frac{(L_j\cdot\tan\beta_j)}{(L_i\cdot\tan\beta_i)}\right|\cdot\left|1-\frac{(L_j\cdot\tan\gamma_j)}{(L_i\cdot\tan\gamma_i)}\right|\leq 0.10 \quad (2)$$

Where,

L: nozzle spray distance (m)

β: nozzle major axis direction spray angle (degree)

γ: nozzle minor axis direction spray angle (degree)

i,j: arbitrary column (i column, j column) of nozzle provided in rolling direction.

11. The cooling device of the hot-rolled steel sheet according to claim 1, wherein a water volume density of cooling water from each of the plurality of nozzles satisfies the following expression (3), $$Wa^{0.5}\times Ma/(t\times V)\geq 0.08 \quad (3)$$

Where,

Wa: water volume density of cooling water from nozzle ($m^3/m^2\cdot min$)

Ma: cooling-span length in rolling direction at cooling device (m)

t: sheet thickness of hot-rolled steel sheet (mm)

V: sheet-passing speed of hot-rolled steel sheet (m/s).

12. Equipment comprising:

the cooling device of the hot-rolled steel sheet according to claim 1, and a cooling zone including a plurality of cooling nozzles which spray cooling water toward at least the upper surface of the hot-rolled steel sheet is disposed on a downstream side of a measurement device which measures the hot-rolled steel sheet on the exit side of the rolling stand on the most downstream side of the hot-finish-rolling mill, a water volume density of the cooling water from the cooling nozzle is $2^3/m^2$ min or more, and satisfies the following expression (4), $$Wb^{0.5}\times Mb/(t\times V)\geq 0.55 \quad (4)$$

Where,

Wb: water volume density of cooling water from cooling nozzle ($m^3/m^2\cdot min$)

Mb: cooling-span length in rolling direction at cooling zone (m)

t: sheet thickness of hot-rolled steel sheet (mm)

V: sheet-passing speed of hot-rolled steel sheet (m/s).

13. Hot-rolling equipment comprising:

the cooling device of the hot-rolled steel sheet according to claim 1, wherein the cooling device is disposed between the rolling stands, reduction rolls of the rolling stand on a downstream side than the cooling device are opened, a roll gap of the reduction rolls is set to a value where 7 mm is added to an aimed sheet thickness or less, and a water spray device which removes water on the sheet leaking out of the rolling stand on the most downstream side is disposed on the exit side of the rolling stand on the most downstream side of the hot-finish-rolling mill.

14. Equipment comprising:

the cooling device of the hot-rolled steel sheet according to claim 1, wherein the cooling; device is disposed on the exit side of the rolling stand on the most downstream side of the hot-finish-rolling mill, and a water spray device which removes water on the sheet running out of the cooling device is disposed on the downstream side of the cooling device.

* * * * *